US008118684B2

(12) United States Patent
Kelly et al.

(10) Patent No.: US 8,118,684 B2
(45) Date of Patent: Feb. 21, 2012

(54) INFANT SUPPORT STRUCTURE WITH A COLLAPSIBLE FRAME

(75) Inventors: Brian Kelly, East Aurora, NY (US); Maarten Van Huystee, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 225 days.

(21) Appl. No.: 12/568,209

(22) Filed: Sep. 28, 2009

(65) Prior Publication Data

US 2010/0255919 A1 Oct. 7, 2010

Related U.S. Application Data

(60) Provisional application No. 61/109,798, filed on Oct. 30, 2008.

(51) Int. Cl.
*A63G 9/02* (2006.01)
*A63G 9/16* (2006.01)

(52) U.S. Cl. ..... 472/118; 472/119

(58) Field of Classification Search ..... 472/118–125; 297/273, 274, 284
See application file for complete search history.

(56) References Cited

U.S. PATENT DOCUMENTS

| | | | | |
|---|---|---|---|---|
| 3,918,760 | A | 11/1975 | Goldberg | |
| 4,044,931 | A | 8/1977 | Catelli | |
| 4,561,138 | A | 12/1985 | Hwang | |
| 6,386,986 | B1 | 5/2002 | Sonner et al. | |
| 6,500,072 | B1 | 12/2002 | Myers et al. | |
| 6,517,151 | B2 | 2/2003 | Liu | |
| 6,645,080 | B1 | 11/2003 | Greger et al. | |
| 6,702,685 | B2 | 3/2004 | Mahlstedt et al. | |
| 6,827,395 | B1 | 12/2004 | Wang et al. | |
| 6,857,966 | B2 * | 2/2005 | Armbruster et al. | 472/118 |
| 6,887,161 | B2 | 5/2005 | Mahlstedt et al. | |
| 6,896,624 | B2 | 5/2005 | Longenecker et al. | |
| 6,932,709 | B1 * | 8/2005 | Gubitosi et al. | 472/118 |
| 7,052,403 | B2 | 5/2006 | Ransil et al. | |
| 7,258,617 | B2 | 8/2007 | Chen | |
| 2003/0160487 | A1 | 8/2003 | Flannery et al. | |
| 2005/0143181 | A1 | 6/2005 | Armbruster et al. | |
| 2007/0145790 | A1 | 6/2007 | Ventrola | |

* cited by examiner

*Primary Examiner* — Kien Nguyen
(74) *Attorney, Agent, or Firm* — Edell, Shapiro & Finnan, LLC

(57) ABSTRACT

An infant support structure with a collapsible frame is disclosed. In one embodiment, the infant support structure includes a frame with a lock mechanism that is configured to maintain the collapsible frame in a deployed or use configuration.

20 Claims, 21 Drawing Sheets

INFANT SUPPORT STRUCTURE WITH A COLLAPSIBLE FRAME

CROSS-REFERENCE TO RELATED APPLICATION

This application claims priority to U.S. Provisional Patent Application Ser. No. 61/109,798, entitled "Infant Support Structure With A Collapsible Frame," filed Oct. 30, 2008, the disclosure of which is incorporated herein by reference in its entirety.

FIELD OF THE INVENTION

The present invention relates to an infant support structure and in particular, to an infant support structure with a collapsible frame. The present invention relates to a frame for an infant support structure that includes a lock mechanism that is configured to maintain the collapsible frame in a deployed or use configuration.

BACKGROUND OF THE INVENTION

Conventional infant support structures include a frame. Some examples of such infant support structures include, but are not limited to, bouncers, swings, infant seats, and high chairs. Often the frame of an infant support structure is collapsible or foldable.

There is a need for an infant support structure that includes a frame that has a mechanism that maintains the frame in a deployed or use configuration and that is easy to manipulate by a user or caregiver to collapse or fold the frame.

SUMMARY OF THE INVENTION

In one embodiment, the present invention relates to an infant support structure that has a collapsible frame that includes a first frame portion including a lower portion configured to engage a support surface and a second frame portion including a lower portion configured to engage the support surface. The second frame portion is pivotally coupled to the first frame portion, and the second frame portion is positionable in a deployed position and in a collapsed position relative to the first frame portion. The frame includes a release mechanism that is coupled to the second frame portion. The release mechanism is configured to receive part of the first frame portion to secure the second frame portion in its deployed position. The frame also includes a support portion that is supported by the collapsible frame.

In one embodiment, the release mechanism includes a housing and a biasing mechanism with the housing being mounted to the second frame portion and movable between a locked position and an unlocked position. As a result, the biasing mechanism biases the housing into its locked position. In another embodiment, the first frame portion includes an upper end and a lower end, and the second frame portion includes an upper end and a lower end. The upper end of the second frame portion is pivotally coupled to the upper end of the first frame portion.

The second frame portion can be a rear frame portion that includes a first leg, a second leg, and a lower member coupling the first leg and the second leg to each other. In this implementation, the release mechanism is coupled to the first leg of the rear frame portion. In addition, the infant support structure may include a second release mechanism coupled to a leg portion, with the second release mechanism being configured to receive part of the first frame portion to secure the second frame portion in its deployed position. In one method of operation, the first release mechanism and the second release mechanism can be moved substantially simultaneously. The first frame portion includes a first engaging portion and a second engaging portion. A first release mechanism is configured to receive the first engaging portion, and a second release mechanism is configured to receive the second engaging portion.

In an alternative embodiment, the present invention relates to an infant swing with a front frame portion and a rear frame portion. The rear frame portion is pivotally coupled to the front frame portion and the front frame portion and the rear frame portion are collectively positionable in a deployed configuration and in a collapsed configuration. The rear frame portion includes a lock mechanism that is movable between an engaged position and a disengaged position. The lock mechanism in its engaged position receives a portion of the front frame portion to secure the front frame portion and the rear frame portion in the deployed configuration. The lock mechanism in its disengaged position is configured to release the portion of the front frame portion to allow the front frame portion and the rear frame portion to move to the collapsed configuration. The infant swing includes a seat portion that is movably supported by the front frame portion.

The lock mechanism may include a housing and a biasing mechanism. The housing of the lock mechanism is pivotally mounted to the rear frame portion and the biasing mechanism biases the housing into the engaged position. In one embodiment, the front frame portion includes a pair of hubs and a front leg assembly with two upper ends. Each of the hubs is coupled to one of the upper ends of the front leg assembly and the lock mechanism is configured to receive a portion of one of the hubs.

In another embodiment, the rear frame portion includes a first leg portion and a second leg portion. Each of the leg portions is pivotally coupled to the front frame portion and the lock mechanism is coupled to the first leg portion of the rear frame portion. In yet another embodiment, the infant swing includes a second lock mechanism that is coupled to the second leg portion. The second lock mechanism is configured to receive part of the front frame portion to secure the rear frame portion in its deployed position. In one exemplary mode of operation, the first lock mechanism and the second lock mechanism can be moved independently of each other In another embodiment, the infant support structure includes a first connector, a second connector, a first frame member, and a second frame member. The first frame member is fixedly coupled to the first connector and to the second connector and configured to engage a support surface. The second frame member is pivotally coupled to the first connector and to the second connector. The second frame member is configured to engage a support surface and is positionable in a deployed position and in a collapsed position relative to the first frame member. The second frame member includes a lock mechanism coupled thereto with the lock mechanism being configured to receive a portion of the first connector to retain the second frame member in its deployed position. The infant support structure also includes a seat portion that is supported by the first connector and the second connector.

In one embodiment, the first frame member includes a first leg member and a second leg member, and the second frame member includes a first leg member and a second leg member. Each of the first leg members is coupled to the first connector, and each of the second leg members is coupled to the second connector. The lock mechanism is coupled to one of the leg members of the second frame member. In an alternative embodiment, the lock mechanism is coupled to a first leg member and the infant support structure includes a second lock mechanism that is coupled to the second leg member of the second frame member. The second lock mechanism is configured to receive a portion of the second connector. In one exemplary mode of operation, the first lock mechanism and the second lock mechanism can be manipulated simultaneously. In addition, the lock mechanism is pivotally mounted to the second frame member.

In one embodiment, the first connector has a body portion and a housing rotatably coupled to the body portion. The second frame member includes an upper end that is coupled to the housing. The housing is rotatable relative to the body portion when the lock mechanism is disengaged from the first connector.

BRIEF DESCRIPTION OF THE DRAWINGS

Like reference numerals have been used to identify like elements throughout this disclosure.

DETAILED DESCRIPTION OF THE INVENTION

Figure 1A:
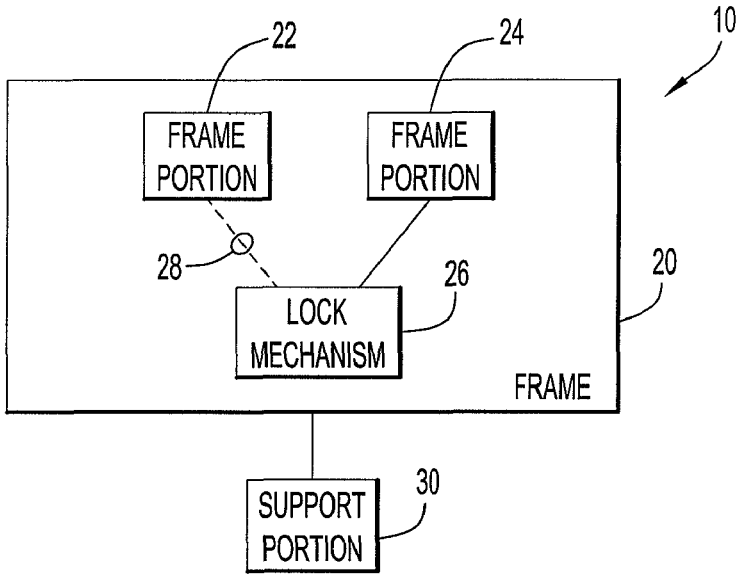
FIG. 1A is a schematic block diagram of an embodiment of an infant support structure according to the present invention.

Referring to FIG. 1A, a schematic block diagram of an embodiment of an infant support structure according to the present invention is illustrated. In this embodiment, the infant support structure 10 includes a frame 20 that has frame portions 22 and 24. The frame 20 of the infant support structure 10 also includes a lock mechanism 26 that is coupleable to the frame portions 22 and 24. The term "lock mechanism" used herein can be referred to alternatively as a release mechanism or a latch or latch mechanism. The lock mechanism 26 can be used to maintain the frame portions 22 and 24 in a spaced apart or deployed configuration. In one embodiment, the lock mechanism 26 can be coupled to frame member 24 and detachably coupled to frame portion 22. In particular, the lock mechanism 26 can be configured to receive a part of the frame portion 22 to prevent frame portion 22 from moving relative to frame portion 24. The detachable engagement of the lock mechanism 26 and the frame portion 22 is illustrated in FIG. 1A as a dashed line 28.

The infant support structure 10 also includes a support portion 30 that is configured to receive and support an infant or child. In one embodiment, the infant support structure 10 can be an infant swing. In other embodiments, the infant support structure can be a high chair, a bouncer, or other structure that can be used to support an infant.

Figure 1B:
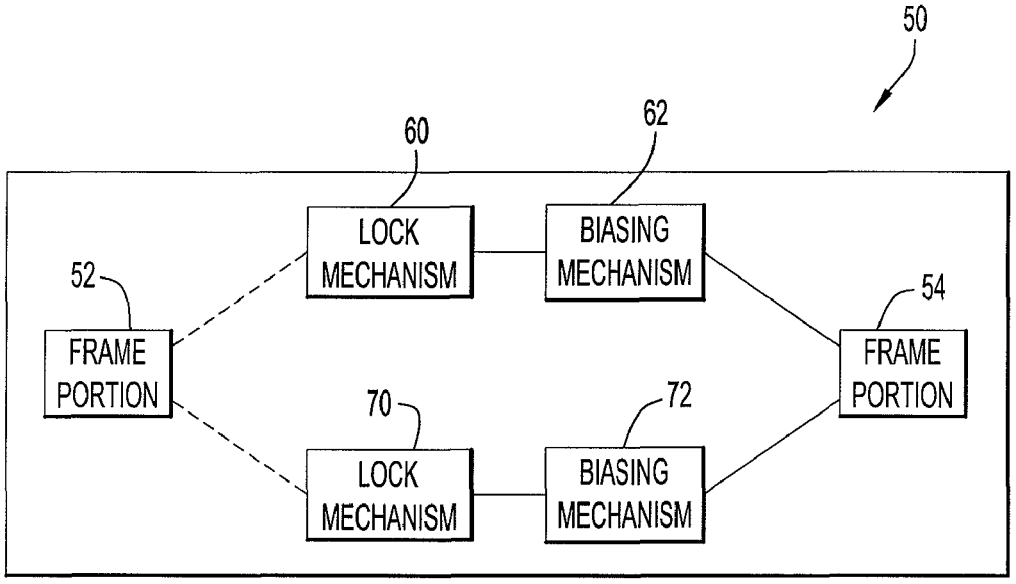
FIG. 1B is a schematic block diagram of an alternative embodiment of an infant support structure according to the present invention.

Referring to FIG. 1B, an alternative embodiment of an infant support structure according to the present invention is illustrated. In this embodiment, the infant support structure 50 includes frame portions 52 and 54. Frame portion 54 is mounted for movement relative to frame portion 52. Frame portion 54 includes lock mechanisms 60 and 70 that have biasing mechanisms 62 and 72 that force the lock mechanisms 60 and 70 into their engaged or locked positions. A user can manipulate the lock mechanisms 60 and 70 against the biasing mechanisms 62 and 72 to disengage the frame portion 52 from the lock mechanisms 60 and 70. In another embodiment, each of the frame portions 52 and 54 is mounted for pivotal movement relative to the other of the frame portions.

Referring to FIGS. 2-5, an embodiment of an infant support structure according to the present invention is illustrated. In this embodiment, the infant support structure 100 includes a frame 110 that is configured to be placed on a support surface 90. The infant support structure 100 includes a support portion 700 that is configured to receive and support an infant. The frame 110 is positionable in a deployed or use configuration 112 as shown in FIGS. 2-5.

Figure 4:
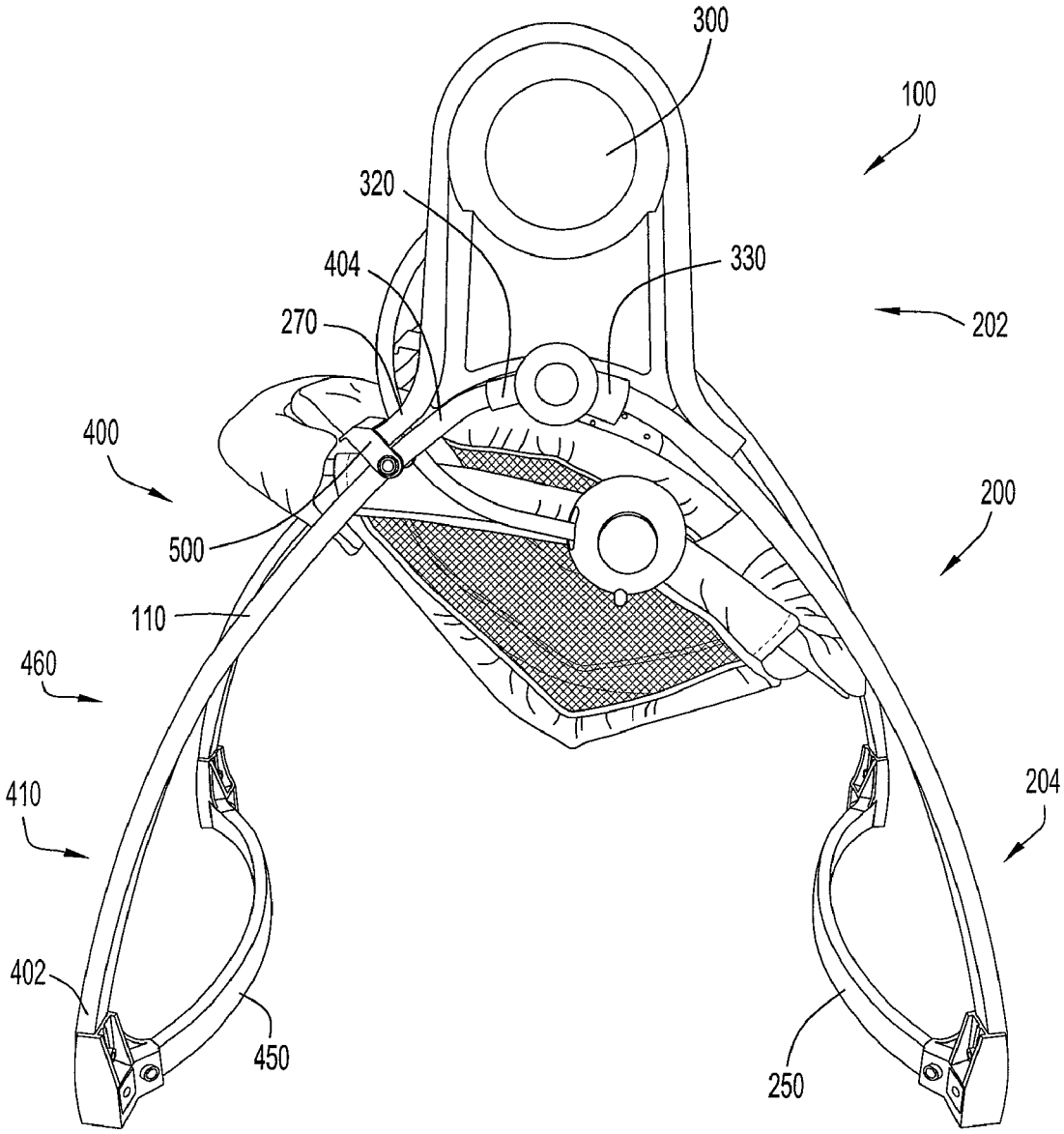
FIG. 4 is a side view of the infant support structure illustrated in FIG. 2.

The frame 110 has a first frame portion or member 200 and a second frame portion or member 400. The first frame portion 200 can be referred to alternatively as a front frame portion. Similarly, the second frame portion 400 can be referred to alternatively as a rear frame portion. Referring to FIG. 4, frame portion 200 includes an upper end 202 and a lower end 204 with a lower portion 210 that is configured to engage support surface 90. Similarly, frame portion 400 includes an upper end 404 and a lower end 402 with a lower portion 410 that is configured to be placed on a support surface 90.

Figure 2:
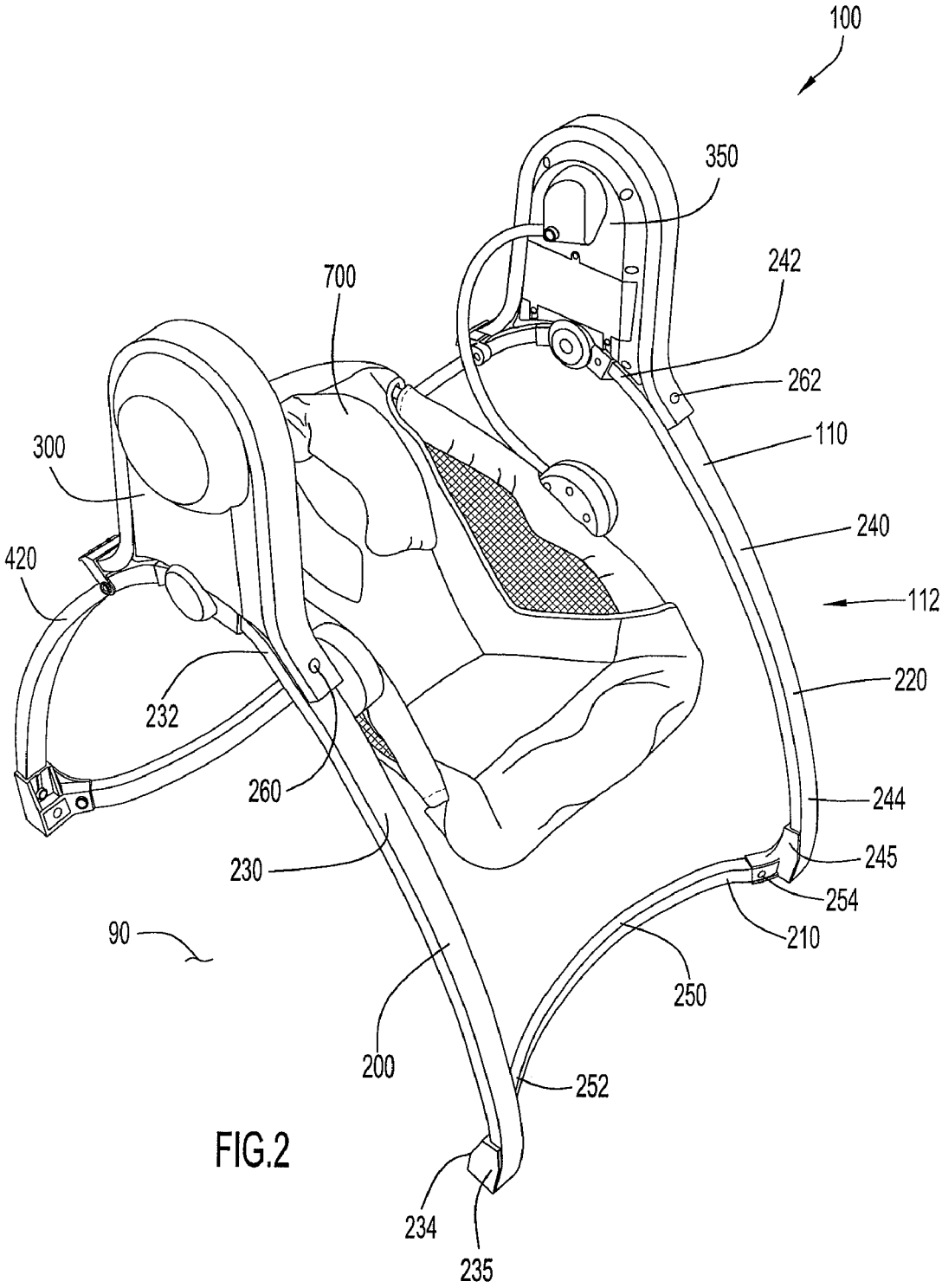
FIG. 2 is a front perspective view of an embodiment of an infant support structure according to the present invention.

As shown in FIG. 2, frame portion 200 includes a leg assembly 220 that has legs 230 and 240 and a lower member 250 that is coupled to the legs 230 and 240. Leg assembly 220 can be referred to in this embodiment as a front leg assembly 220. The legs 230 and 240 can be referred to alternatively as leg portions or leg members. The legs 230 and 240 and lower member 250 can be formed separately and coupled to together using fasteners, such as screws. Alternatively, the legs 230 and 240 and the lower member 250 can be integrally formed. While legs 230 and 240 and lower member 250 are illustrated as made of wood, in other embodiments, those components can be made of different materials, such as plastic or metal.

Referring back to FIG. 2, the frame 110 includes hubs or connectors 300 and 350 that are disposed on opposite sides of the frame 110. Each of the leg assemblies 220 and 420 is coupled to each of the hubs 300 and 350. In one embodiment, leg assembly 220 is fixedly coupled to the hubs 300 and 350 using fasteners, such as screws. As a result, the hubs 300 and 350 move with the leg assembly 220 and can be considered to be part of frame portion 200.

As shown in FIG. 2, the lower member 250 is an elongate member with opposite ends 252 and 254. Leg portion 230 has an upper end 232 and a lower end 234 to which a foot 235 and end 252 of lower member 250 is coupled. Similarly, leg portion 240 has an upper end 242 and a lower end 244 to which a foot 245 and end 254 of lower member 250 is coupled. The upper end 232 of leg portion 230 can be coupled to connector 300 via fastener 260. Similarly, the upper end 242 of leg portion 240 can be coupled to connector 350 via fastener 262.

Figure 3:
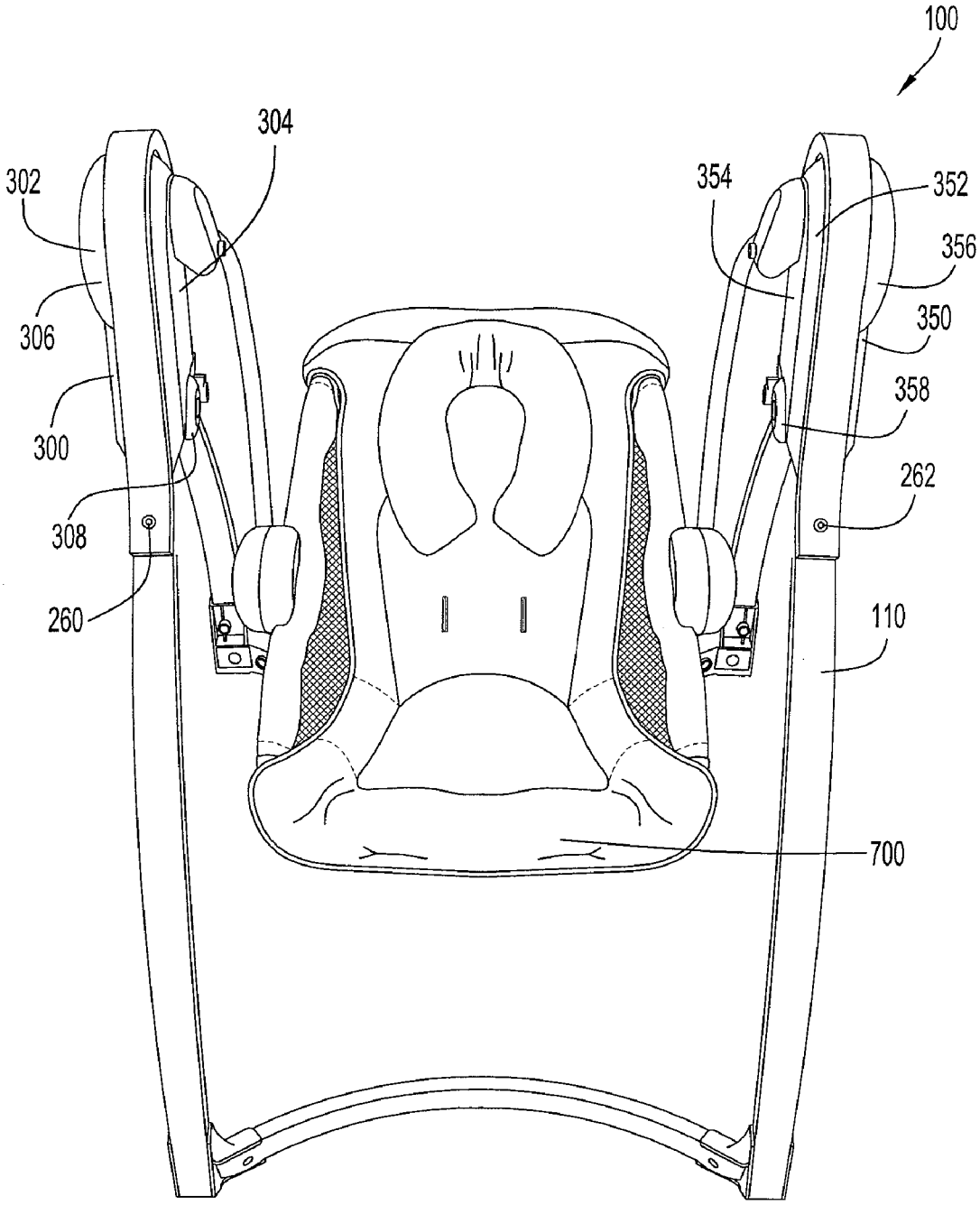
FIG. 3 is a front view of the infant support structure illustrated in FIG. 2.

Referring to FIG. 3, some of the features of the connectors 300 and 350 are illustrated. As shown, connector 300 includes a body portion 302 that has an inner surface 304, an outer surface 306, and a lower end 308. Connector 350 includes a body portion 352 that has an inner surface 354, an outer surface 356, and a lower end 358. The body portions 302 and 352 can be referred to alternatively as housings or members.

Referring to FIG. 4, frame portion or member 400 is illustrated in its deployed or use position 460 with lower members 250 and 450 located proximate to or engaging the support surface 90. The frame portion 400 can be a rear frame portion and can include a leg assembly 420, which in this embodiment can be referred to as a rear leg assembly 420. In this position 460, one of the upper ends of leg assembly 420 is coupled to coupler 320 which is pivotally mounted to the body of the connector 300. One of the upper ends of leg assembly 220 is coupled to coupler 330 which is fixedly mounted to or formed integrally with the body of the connector 300. Connector 300 includes an engaging portion 270 that is engaged by a lock mechanism 500 that is coupled to the leg assembly 420. The lock mechanism 500 receives the engaging portion 270 and as a result, prevents the movement of the leg assembly 420 relative to the connector 300 and leg assembly 220.

Figure 5:
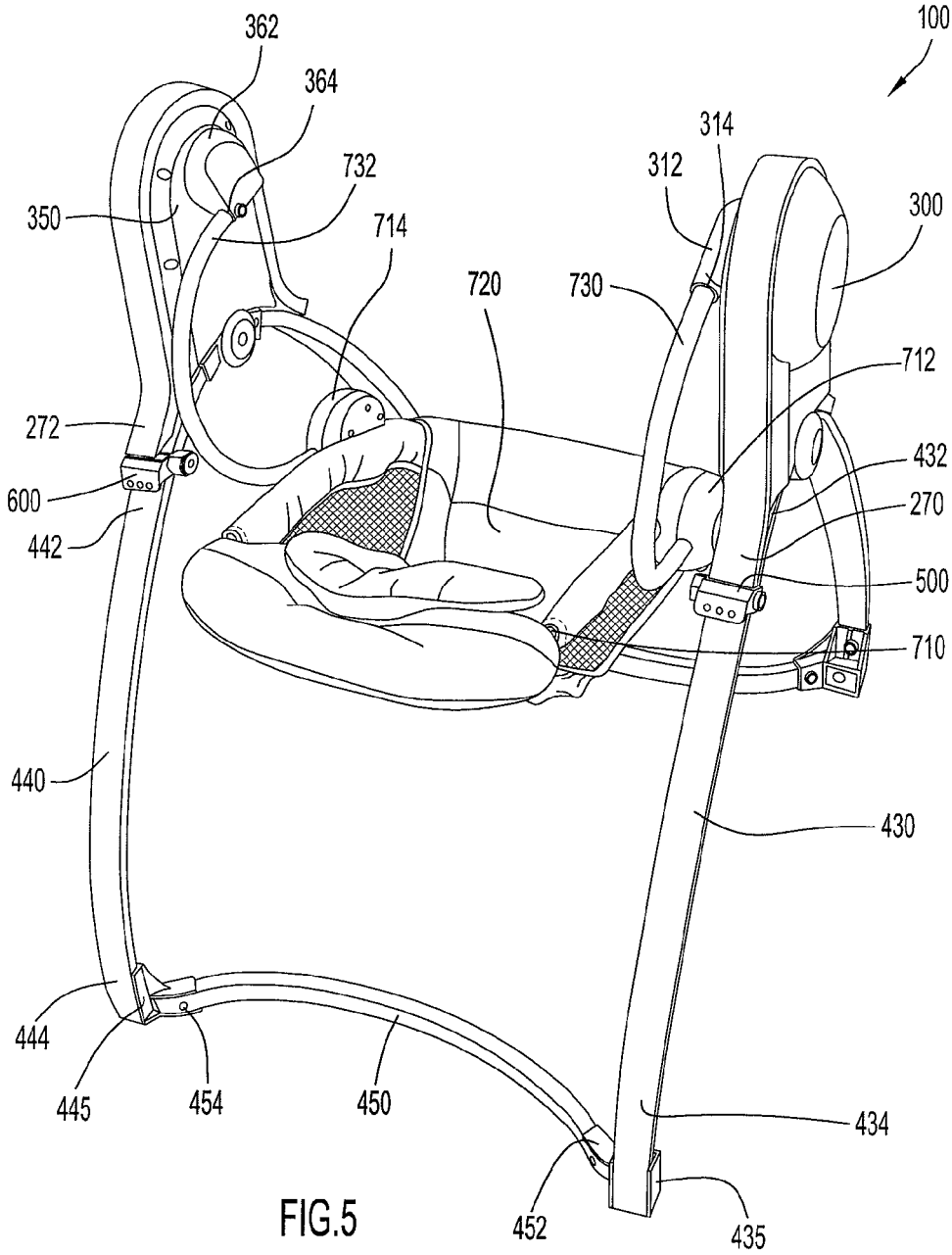
FIG. 5 is a rear perspective view of the infant support structure illustrated in FIG. 2.

Referring to FIG. 5, the leg assembly 420, which in this embodiment is a rear leg assembly, is illustrated in detail. Leg assembly 420 includes leg 430 and leg 440. The legs 430 and 440 can be referred to alternatively as leg portions or leg members. Leg 430 includes an upper end 432 and a lower end 434 to which a foot 435 is coupled. Similarly, leg 440 includes an upper end 442 and a lower end 444 to which a foot 445 is coupled. The leg assembly 420 also includes a lower member 450 that is elongate and that has opposite ends 452 and 454. In one embodiment, the ends 452 and 454 are connected to feet 435 and 445, respectively. In alternative embodiments, the feet 435 and 445 may be formed integrally with the legs 430 and 440 or the lower member 450. In this embodiment, the legs 430 and 440 and lower member 450 are formed separately and coupled to together using fasteners, such as screws. Alternatively, the legs 430 and 440 and the lower member 450 can be integrally formed. While legs 430 and 440 and lower member 450 are illustrated as made of wood, in other embodiments, those components can be made of different materials, such as plastic or metal.

As shown in FIG. 5, leg assembly 420 includes lock mechanisms 500 and 600 coupled thereto. The lock mechanisms 500 and 600 are configured to engage, and in particular receive, portions 270 and 272 of the frame portion 220, respectively. The lock mechanisms 500 and 600 are illustrated in their locked positions in FIG. 5.

Referring to FIG. 5, the infant support structure 100 includes a support portion 700 that is movably supported by the frame 110 for reciprocating motion relative thereto. A drive mechanism (not shown) is operably coupled to the support portion 700 to move the support portion 700 back and forth relative to the frame 110. As shown, each of the connectors 300 and 350 includes a mount 312 and 362 rotatably coupled thereto, respectively. The mounts 312 and 362 include openings 314 and 364, respectively. One or both of the mounts 312 and 362 are connected to the drive mechanism of the infant support structure 100.

The support portion 700 includes a frame 710 to which a pad or softgoods portion or assembly 720 is mounted. The frame 710 includes hubs 712 and 714 on opposite side of the frame 710. The hubs 712 and 714 may include recline mechanisms (not shown) that can be manipulated to adjust the inclination of the frame 710. The support portion 700 also includes hanger arms 730 and 732 that are coupled at their lower ends to hubs 712 and 714, respectively. The upper ends of the hanger arms 730 and 732 are inserted into openings 314 and 364, respectively, and secured therein using fasteners, such as screws.

Figure 6:
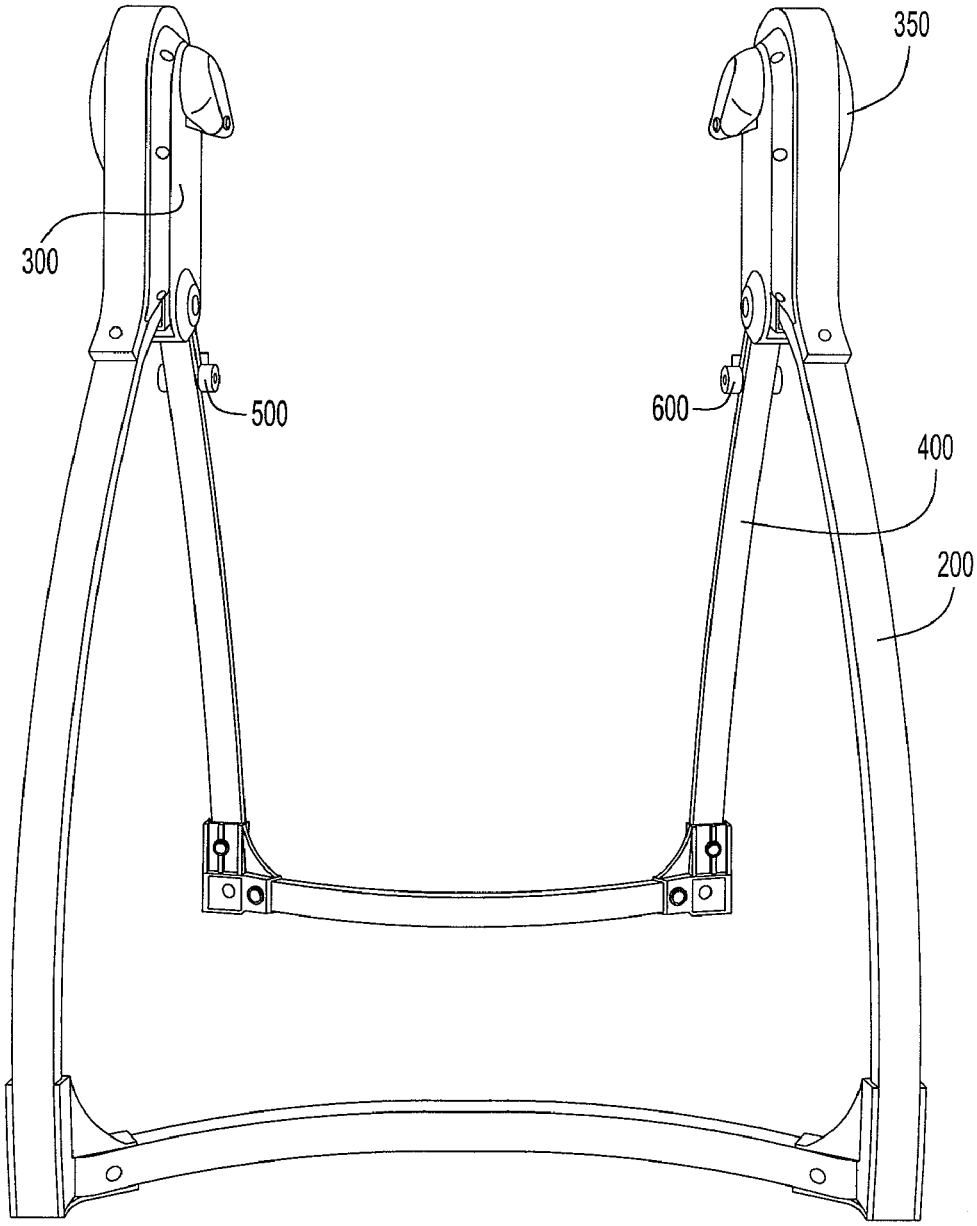
FIG. 6 is a front view of the frame of the infant support structure illustrated in FIG. 2 with the support portion removed.
Figure 7:
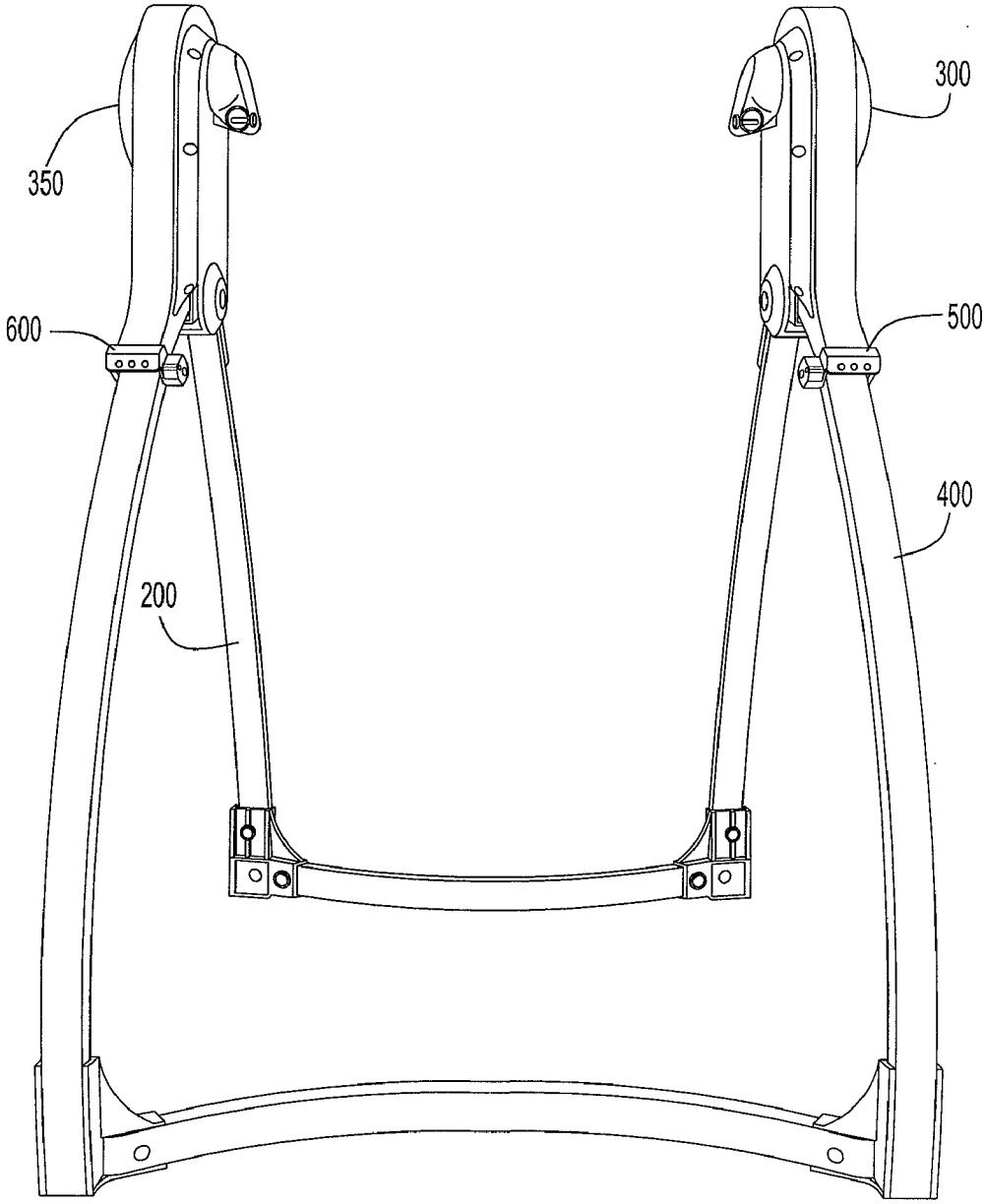
FIG. 7 is a rear view of the frame illustrated in FIG. 6.
Figure 8:
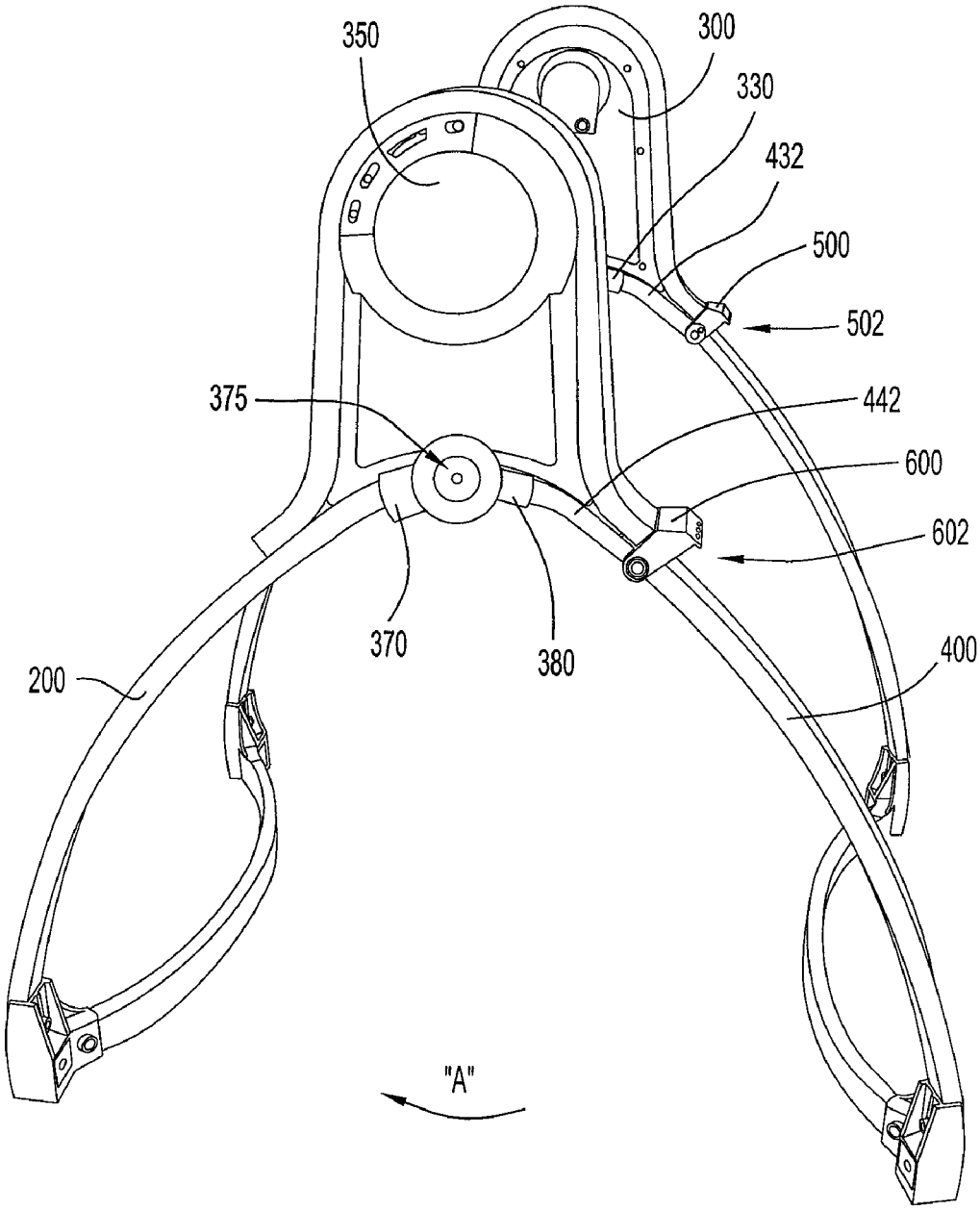
FIG. 8 is a side view of the frame illustrated in FIG. 6.

Referring to FIGS. 6-8, the frame 110 of infant support structure 100 is illustrated with the support portion 700 removed for ease of reference. In FIGS. 6 and 7, frame portions 200 and 400 are shown coupled to connectors 300 and 350. The lock mechanisms 500 and 600 are positioned to maintain the frame portions 200 and 400 in their deployed or use positions. As a result, the frame 110 is in its deployed or use configuration.

Referring to FIG. 8, one leg of frame assembly 200 is connected to coupler 370, which is formed integrally with connector 350 and as a result, does not move relative to the body of the connector 350. Coupler 380, however, is pivotally mounted to the body of the connector 350 and can rotate about axis 375 along the direction of arrow "A." As shown, leg assembly 420, and in particular, upper end 442 of leg 440 is coupled to the coupler 380. As a result, when coupler 380 rotates, leg 440 also rotates in the same direction. Lock mechanism 600 is coupled to leg assembly 420, and in particular, to leg 440. Lock mechanism 600 is illustrated in FIG. 8 in its locked or engaged position 602 in which it receives a portion of the connector 350 to prevent movement or rotation of leg 440 and coupler 380 about axis 375.

Similarly, coupler 330 is pivotally mounted to the body of connector 300. Leg assembly 420, and in particular, the upper end 432 of leg 430 is connected to coupler 330. As a result, when coupler 330 rotates, leg 430 also rotates in the same direction. Lock mechanism 500 is coupled to leg assembly 420, and in particular, to leg 430. The upper end 432 of leg 430 is coupled to coupler 330. Lock mechanism 500 is illustrated in FIG. 8 in its locked or engaged position 502 in which it receives a portion of the connector 300 to prevent movement or rotation of leg 430 and coupler 330 about its rotational axis.

Figure 9:
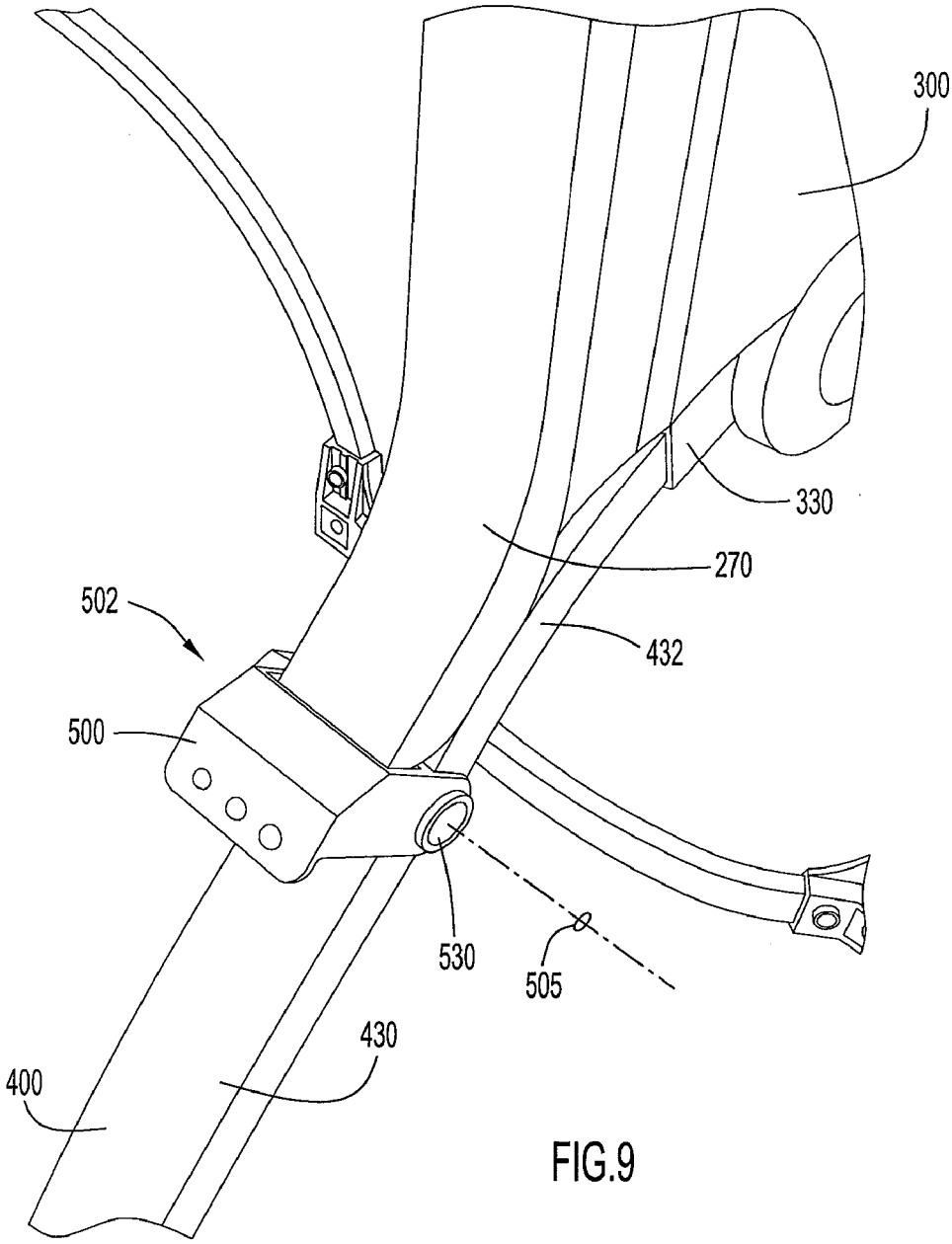
FIGS. 9 and 10 are perspective views of a portion of the frame illustrated in FIG. 6 in a locked configuration.
Figure 10:
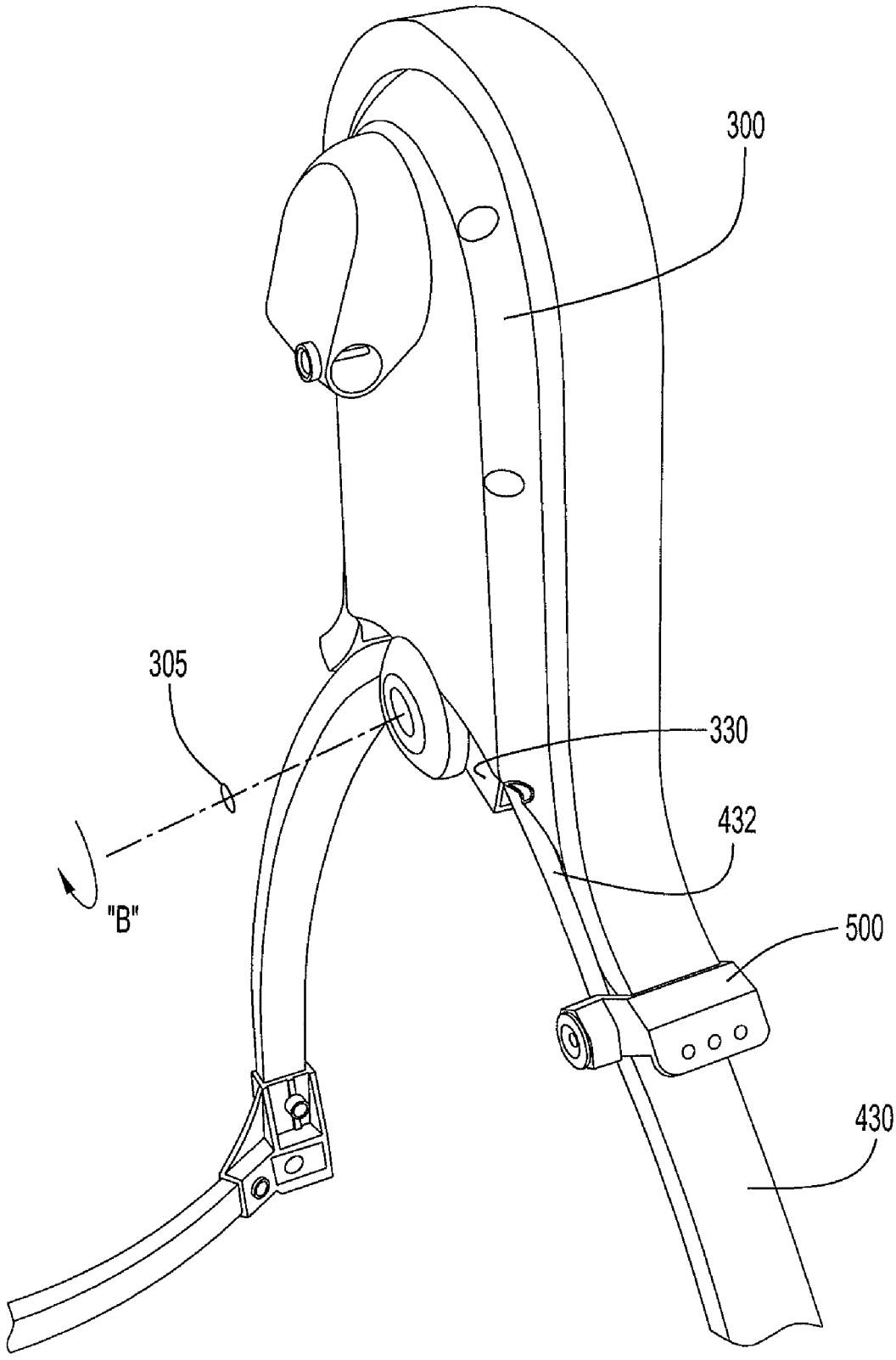

Referring to FIGS. 9-10, close-up views of the interaction between leg assembly 420 and connector 300 is illustrated. The lock mechanism 500 is pivotally mounted to leg assembly 420 by a bolt 530 that defines a pivot axis 505. The lock mechanism 500 is illustrated in its locked or engaged position 502. In this position 502, the lock mechanism 500 engages or receives engaging portion 270 to prevent leg assembly 420 and coupler 330 from moving. In FIG. 10, the axis 305 about which the coupler 330 can rotate is illustrated. In particular, leg 430 and coupler 330 can be rotated along the direction of arrow "B" about axis 305 from the illustrated deployed position to a collapsed position.

Figure 11:
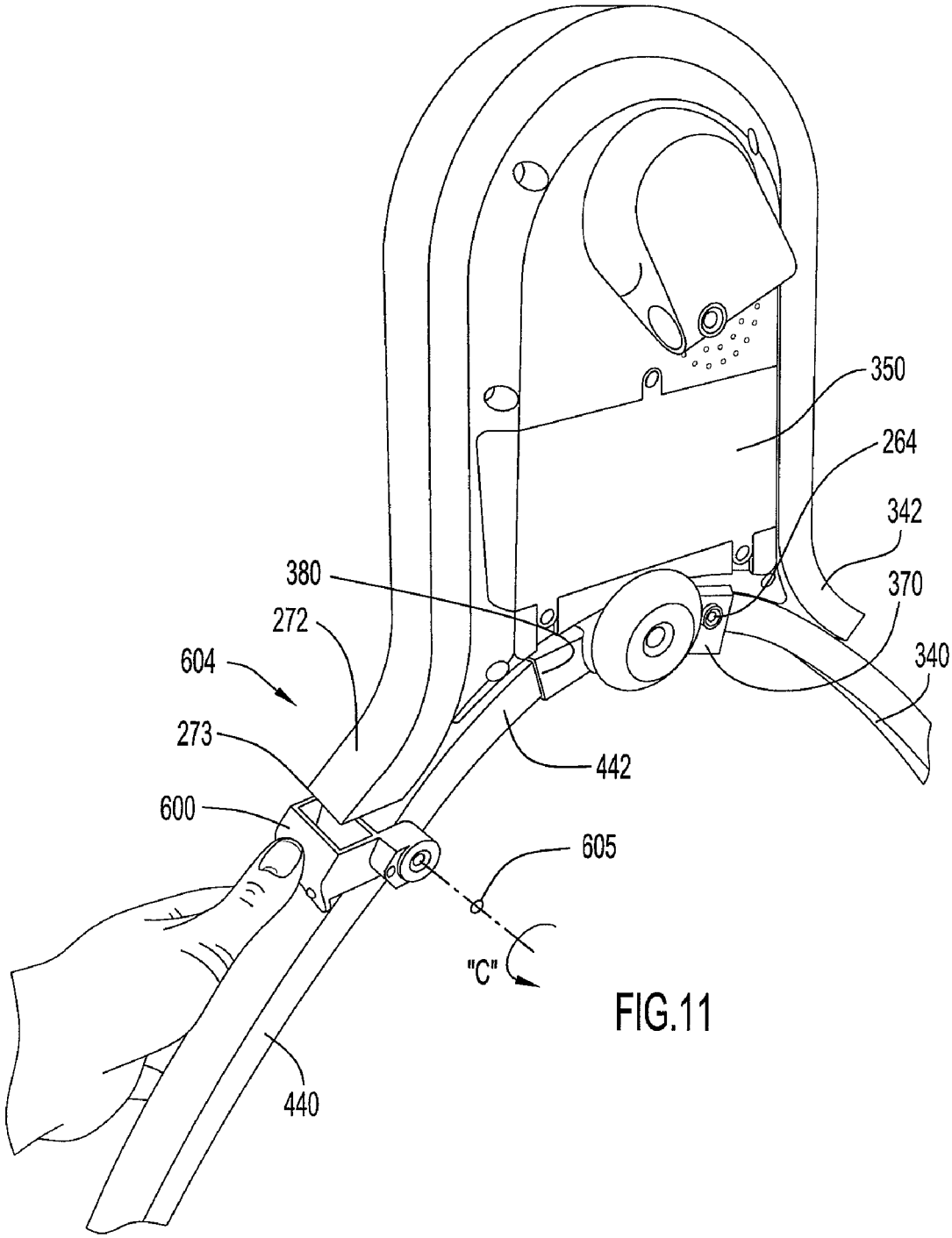
FIG. 11 is a perspective view of a portion of the frame illustrated in FIG. 6 in an unlocked configuration.

Referring to FIG. 11, the upper end 342 of leg 340 is connected to coupler 370 by a fastener 264. Coupler 380 is pivotally mounted to the body of the connector 350 and has upper end 442 of leg 440 connected thereto. As shown, lock mechanism 600 is moved by a user along the direction of arrow "C" about axis 605 to its unlocked or disengaged position 604. When the lock mechanism 600 is in its unlocked position 604, the engaging portion 272, and in particular end 273, of connector 350 is disengaged from lock mechanism 600.

Figure 12:
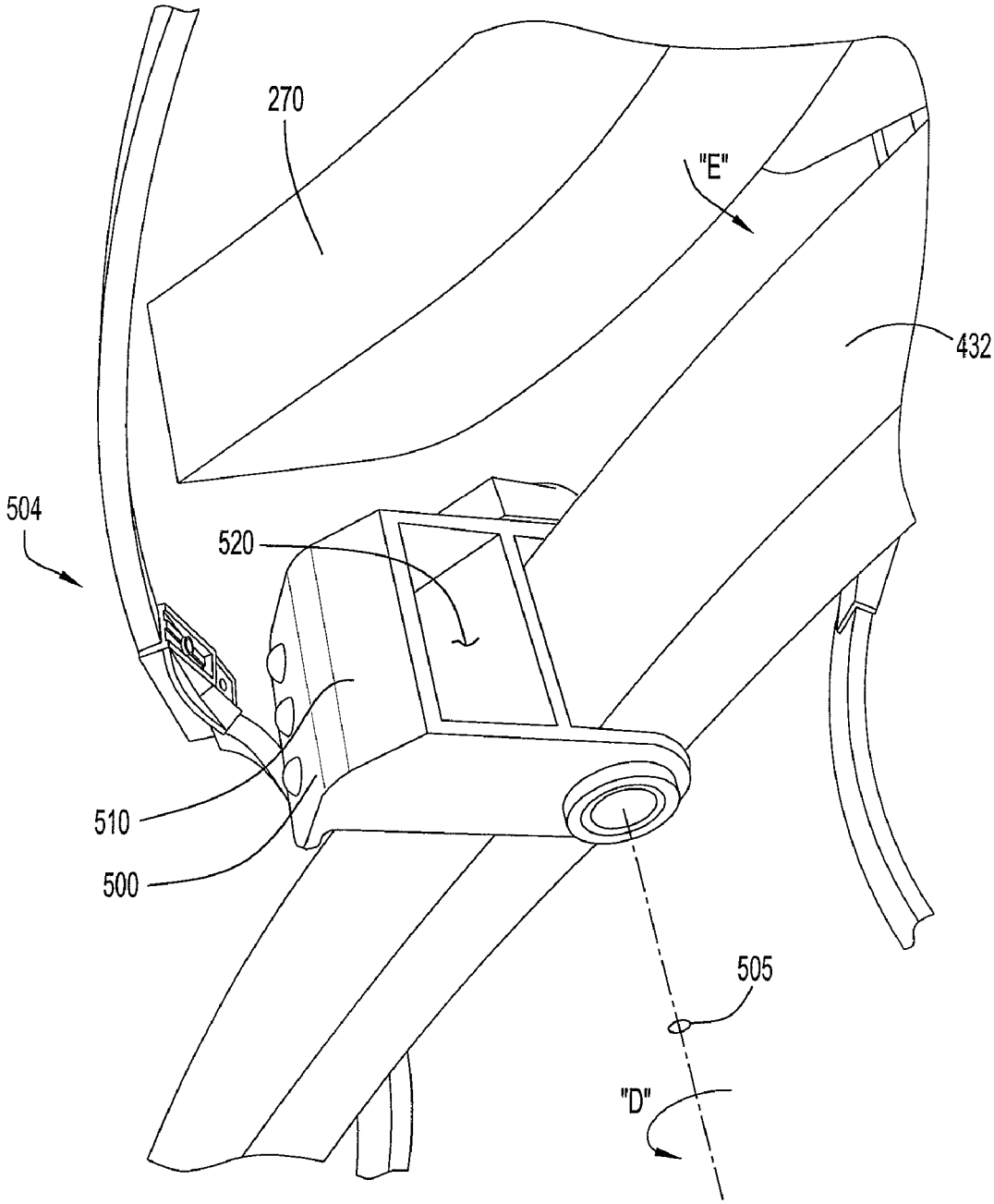
FIG. 12 is a perspective view of another portion of the frame illustrated in FIG. 6 in an unlocked configuration.

Referring to FIG. 12, lock mechanism 500 is rotated about axis 505 along the direction of arrow "D" to its unlocked or disengaged position 504. In this position 504, the lock mechanism 500 does not engage and is spaced apart from the engaging portion 270. As a result, leg 432 can move along the direction of arrow "E" away from the engaging portion 270. As shown, the lock mechanism 500 includes a body 510 that has a receptacle 520 that is configured or shaped to receive the end of the engaging portion 270.

Figure 13:
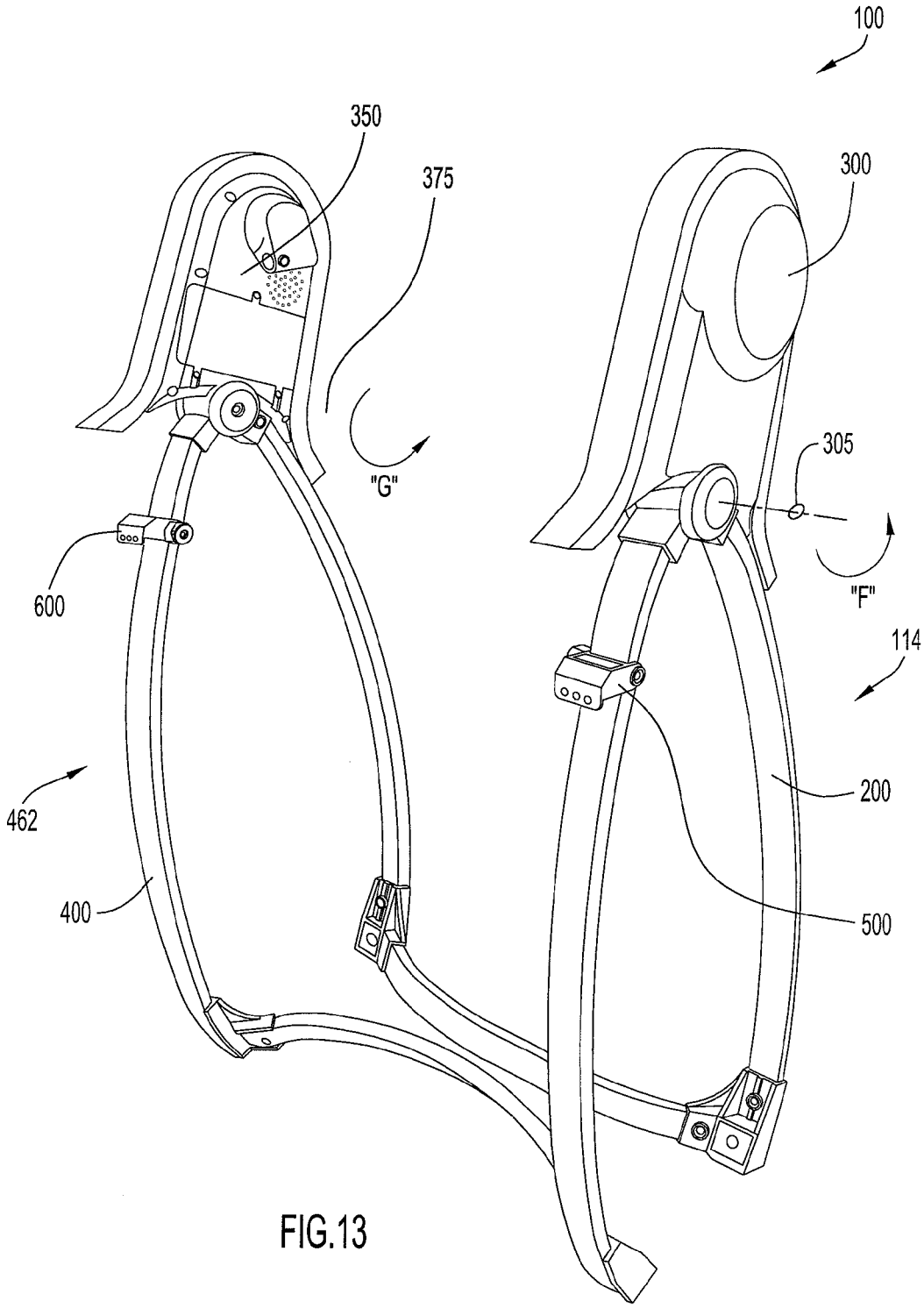
FIG. 13 is a perspective view of the frame illustrated in FIG. 6 in a collapsed configuration.
Figure 14:
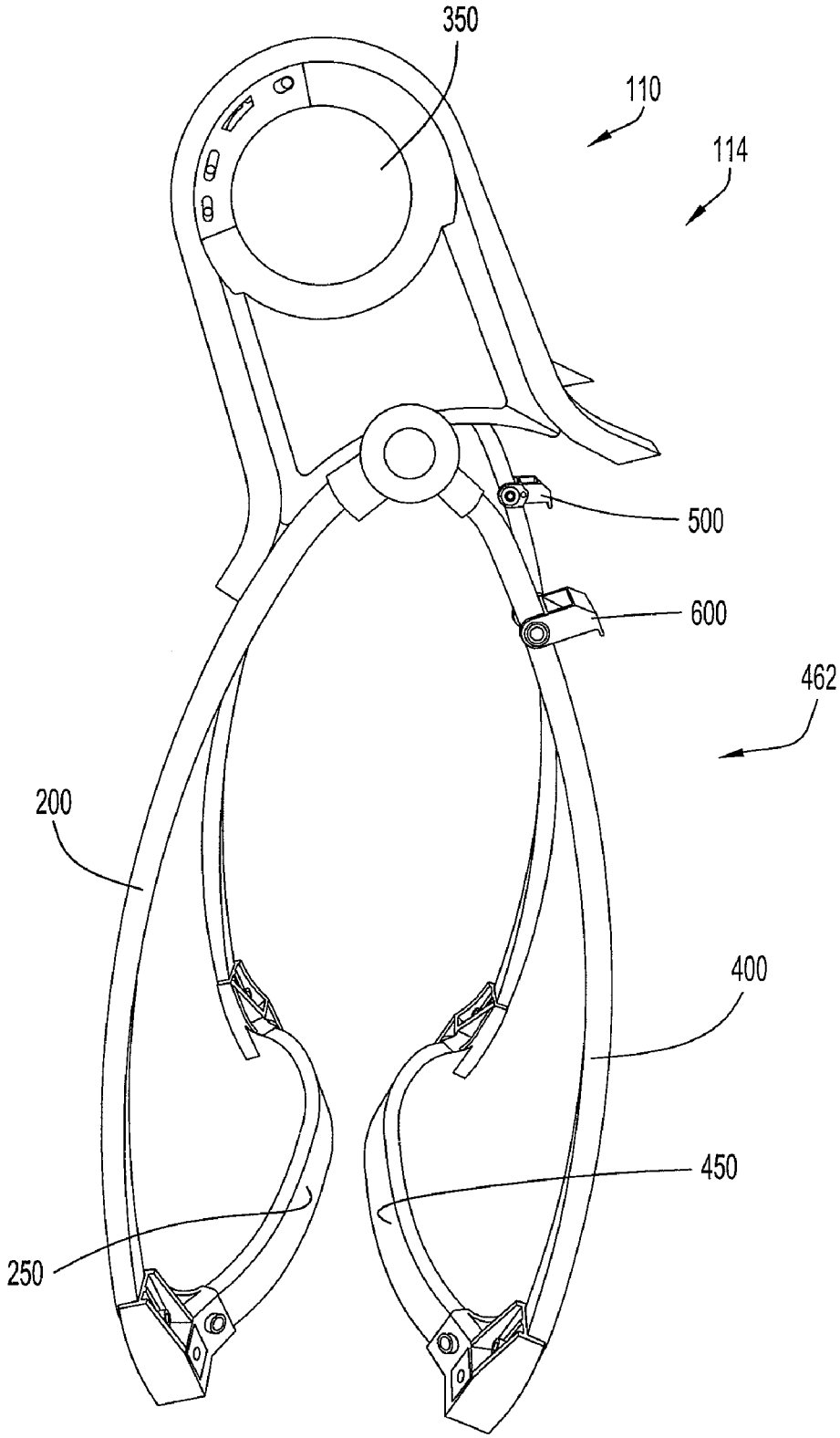
FIG. 14 is a side view of the frame illustrated in FIG. 13.

When lock mechanisms 500 and 600 are both moved to their unlocked positions, leg assembly 420 can be moved to its collapsed position 462 as illustrated in FIGS. 13 and 14. When leg assembly 420 is in its collapsed position 462, the leg assemblies 200 and 400 are proximate to each other and the lower members 250 and 450 are proximate to each other. As shown, the frame 110 is then in a collapsed configuration 114. Referring to FIG. 13, the legs of the leg assembly 420 rotate about axes 305 and 375 along the directions of arrows "F" and "G," respectively.

Referring to FIGS. 15-21, an exemplary embodiment of a lock mechanism according to the present invention is illustrated. In one embodiment, the lock mechanisms 500 and 600 may have the same configuration and components. In an alternative embodiment, the lock mechanisms 500 and 600 may have different configurations or even configurations that are mirror-images of each other. While only lock mechanism 600 is illustrated in FIGS. 15-21, it is to be understood that lock mechanism 500 may have similar components and a similar manner of operation.

Figure 15:
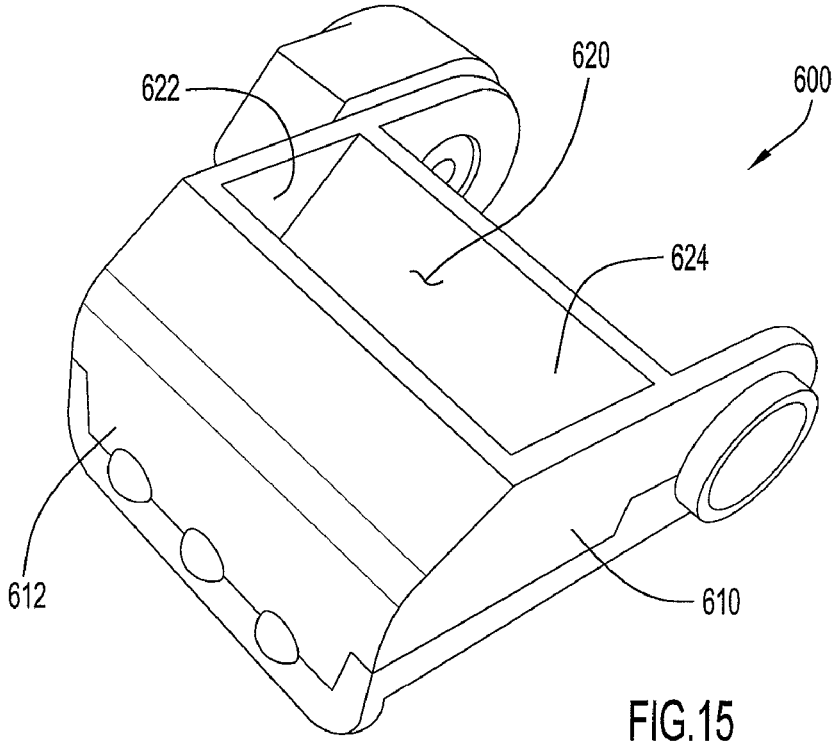
FIG. 15 is a perspective view of an embodiment of a lock mechanism according to the present invention.
Figure 16:
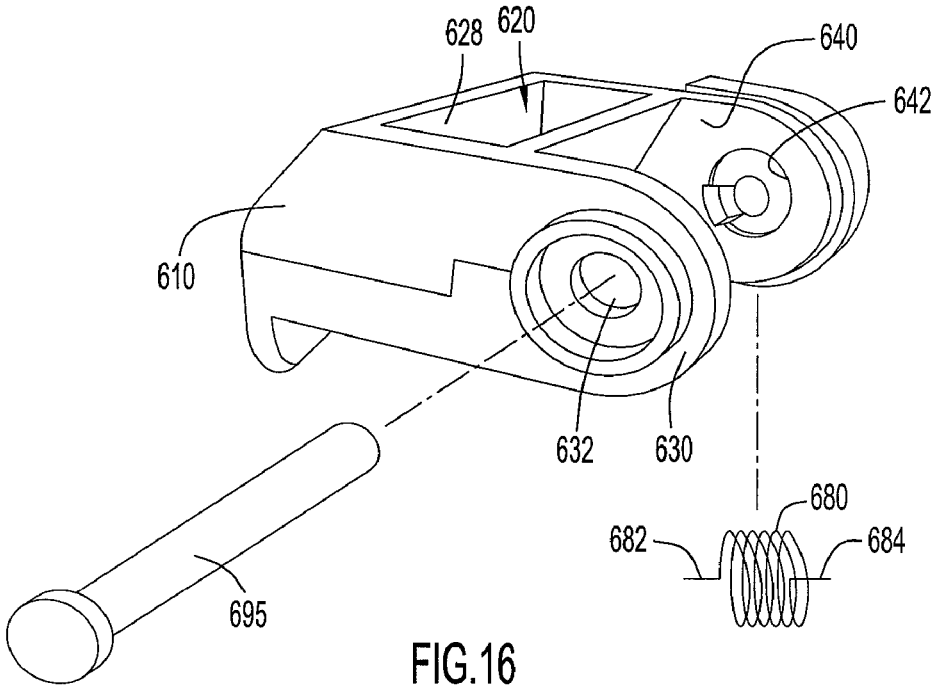
FIG. 16 is an exploded perspective view of the lock mechanism illustrated in FIG. 15.
Figure 17:
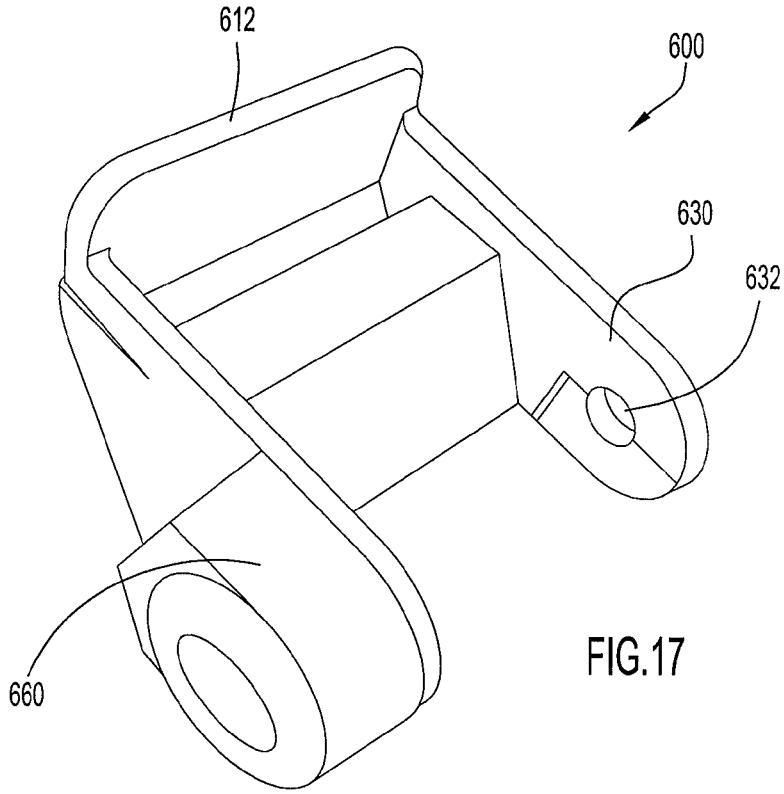
FIG. 17 is a bottom perspective view of the lock mechanism illustrated in FIG. 15.
Figure 21:
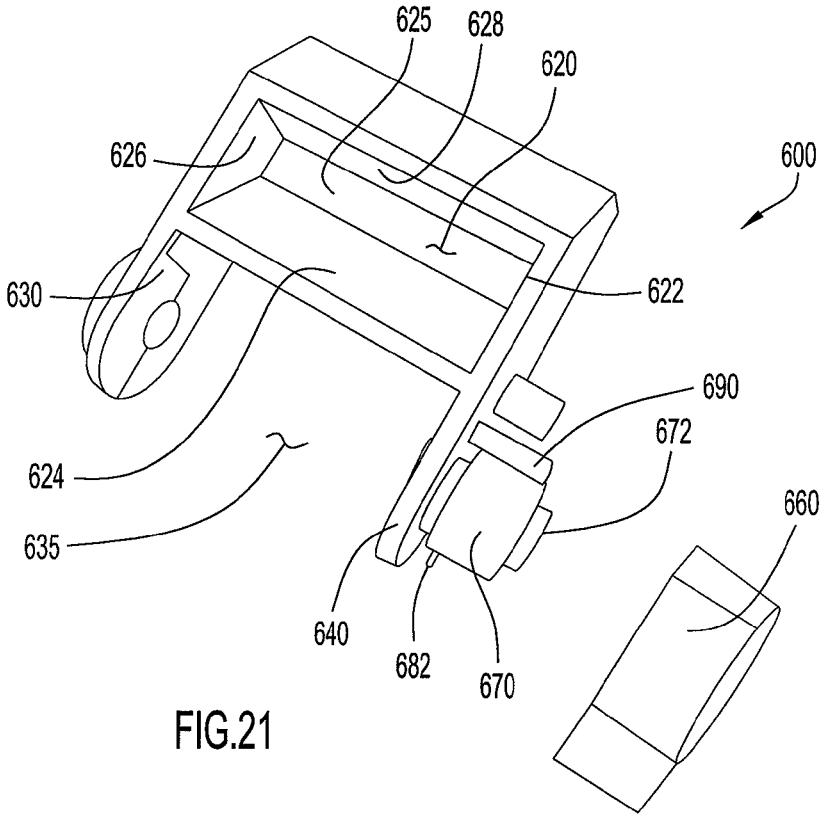

As shown in FIG. 15, lock mechanism 600 includes a body or housing 610 that is made from molded plastic. The body 610 has an engaging portion 612 that a user can engage to impart motion to the housing 610 when it is mounted to a leg of the frame 110. While engaging portion 612 is illustrated with several bumps or protrusions formed thereon, in other embodiments, the engaging portion may be planar or flat. The housing 610 includes a receptacle 620 formed therein that is used to receive part of a receiving portion of a connector, as described above. As shown in FIGS. 15, 16 and 21, the housing 610 includes walls 622, 624, 625, 626, and 628 that collectively define the receptacle 620. Wall 628 may be angled to provide additional resistance to the movement of the engaging portion that is disposed in the receptacle 620.

Figure 18:
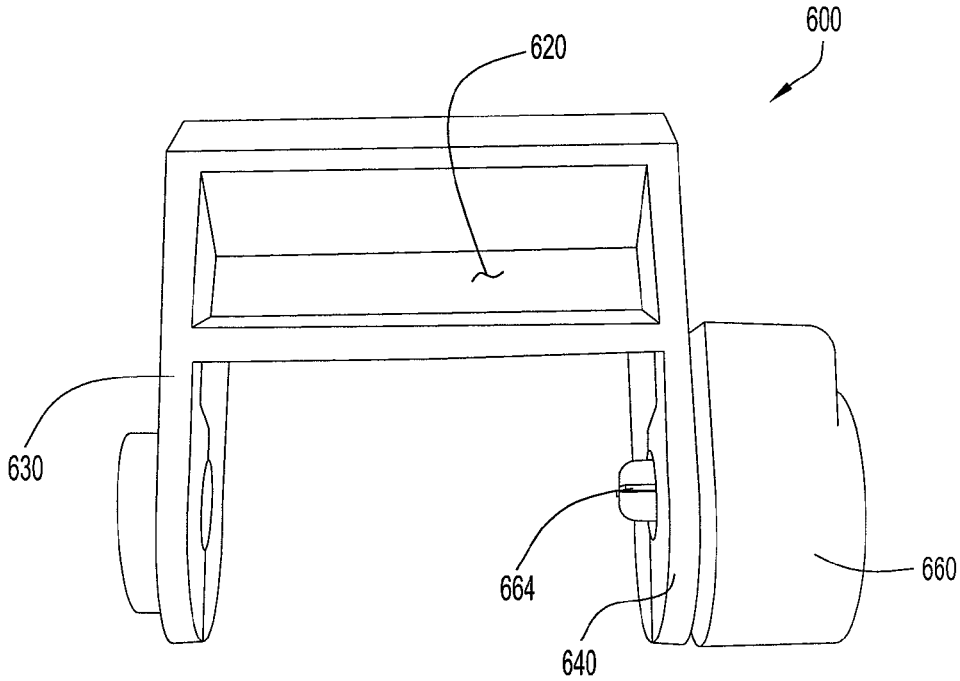
FIG. 18 is an end view of the lock mechanism illustrated in FIG. 15.
Figure 19:
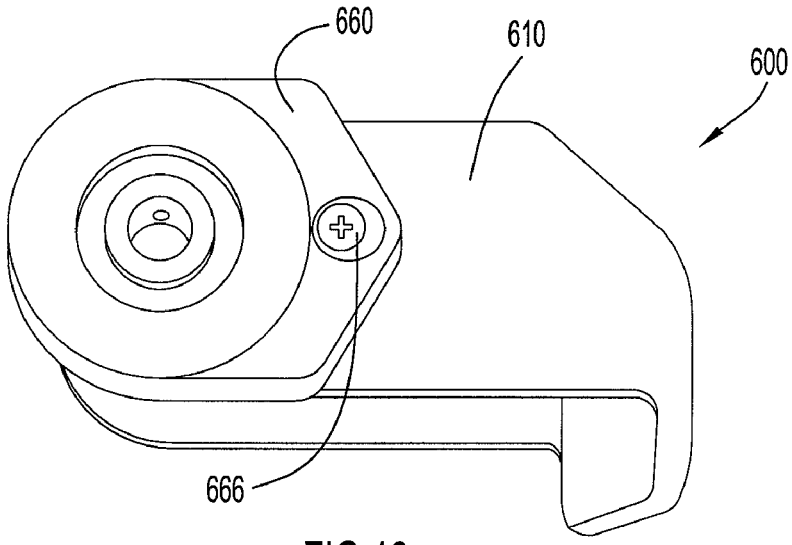
FIG. 19 is a side view of the lock mechanism illustrated in FIG. 15.

As shown in FIG. 19, a housing 660 is coupled to the body or housing 610. This housing 660 is removably coupled to body 610 by a fastener 666. As shown in FIGS. 18 and 21, the body 610 includes flanges or extensions 630 and 640 that extend from body 610 and define a receiving area or channel 635 therebetween. Area 635 is configured to receive a leg of leg assembly 420 therein.

Referring to FIG. 16, extension 630 includes an opening 632 formed therein. Similarly, extension 640 includes an opening 642 formed therein. The openings 632 and 642 are sized to receive a fastener 695 therethrough to mount the body 610 to a leg of the leg assembly 420. As shown in FIG. 16, the lock mechanism 600 also includes a biasing mechanism 680, which in one embodiment, is a torsion spring with ends 682 and 684. The biasing mechanism 680 is used to bias or force the lock mechanism 600 into its locked or engaged position 602.

Referring to FIG. 18, an engagement or projection 664 extends into the space 635. The projection 664 is inserted into or aligned with a slot that is formed in the leg of the leg assembly 420 to which the lock mechanism 600 is mounted. The projection 664 does not move relative to the slot when the lock mechanism 600 is rotated. One end (end 682 as described below) of the biasing mechanism 680 is coupled to the projection 664 and as a result, is held fixed or relatively stationary. The other end (end 684) of the biasing mechanism 680 is coupled to the housing 610 and accordingly, the biasing mechanism 680 provides force to bias the housing 610 into its locked position.

Figure 20:
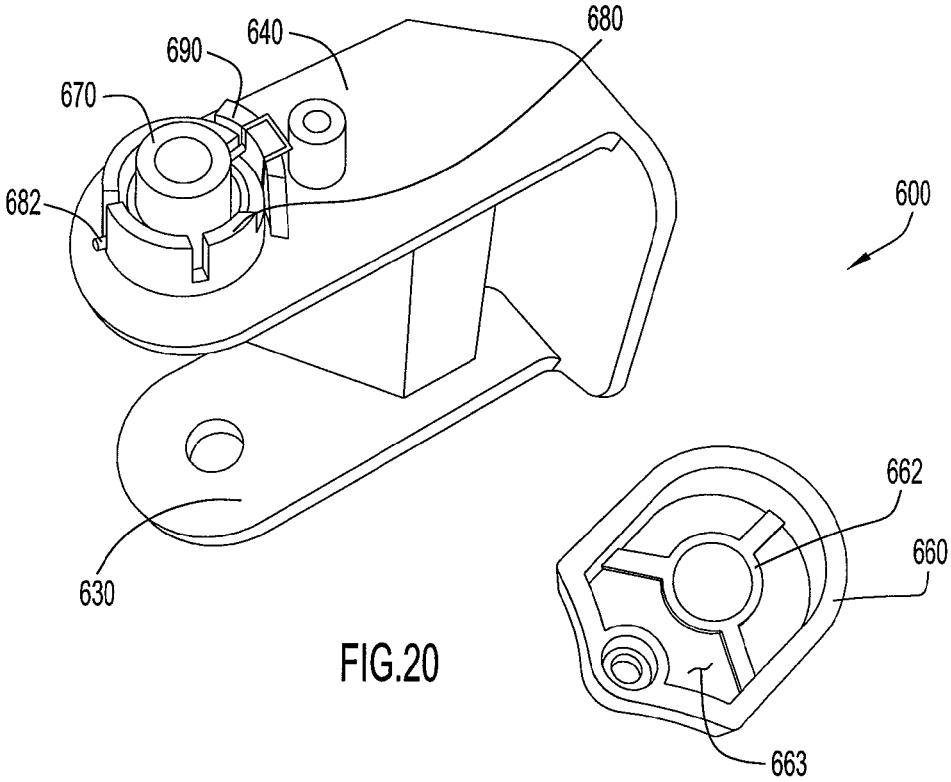
FIGS. 20 and 21 are exploded views of the lock mechanism illustrated in FIG. 15.

Referring to FIGS. 20-21, the housing 660 is removed or decoupled from the body 610. The housing 660 has an inner surface 662 that defines a cavity 663. A sleeve 670 has projection 664 formed thereon. The sleeve 670 is rotatably mounted to the body 610 on a shaft 672 that extends outwardly from the outer surface of mounting portion 640. End 682 of the biasing mechanism 680 is coupled to the sleeve 670 via a slot. A wall or stop 690 is also formed on mounting portion 640. The stop 690 includes a slot formed therein in which end 684 of biasing mechanism 680 is inserted. With ends 682 and 684 of biasing mechanism 680 coupled to different components that move relative to each other, the biasing mechanism 680, in this embodiment a torsion spring, is used to bias the lock mechanism 600 into its locked position 602.

Figure 22:
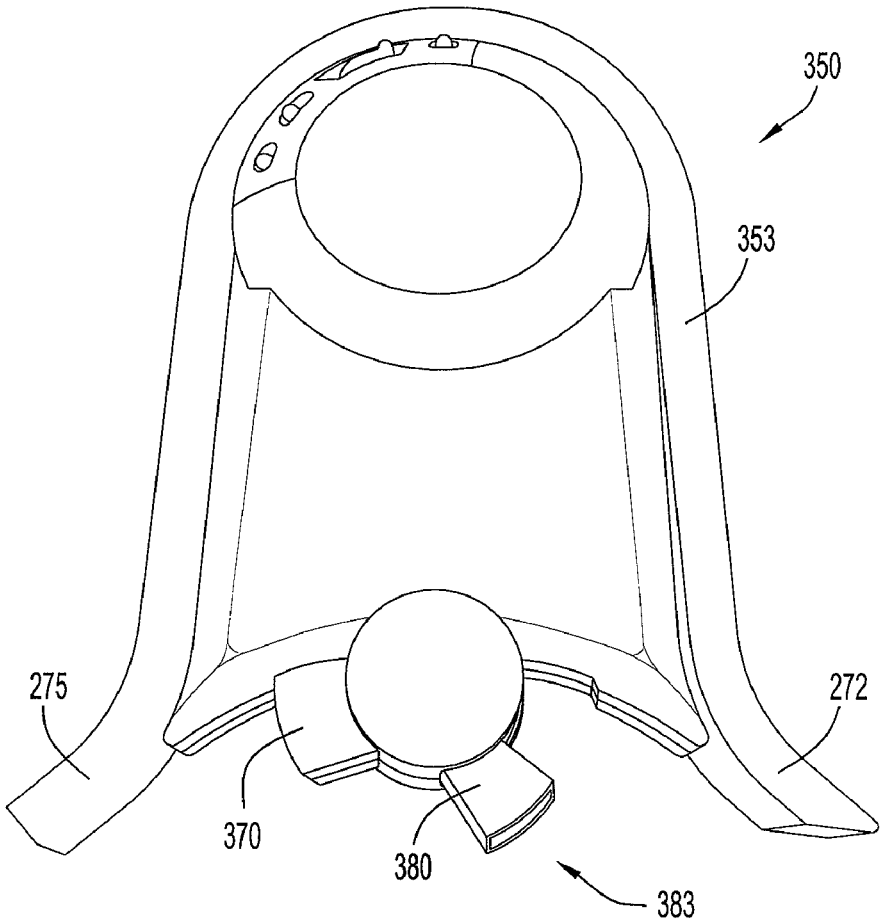
FIGS. 22 and 23 are side views of the connector of the frame illustrated in FIG. 6 in different configurations.
Figure 23:
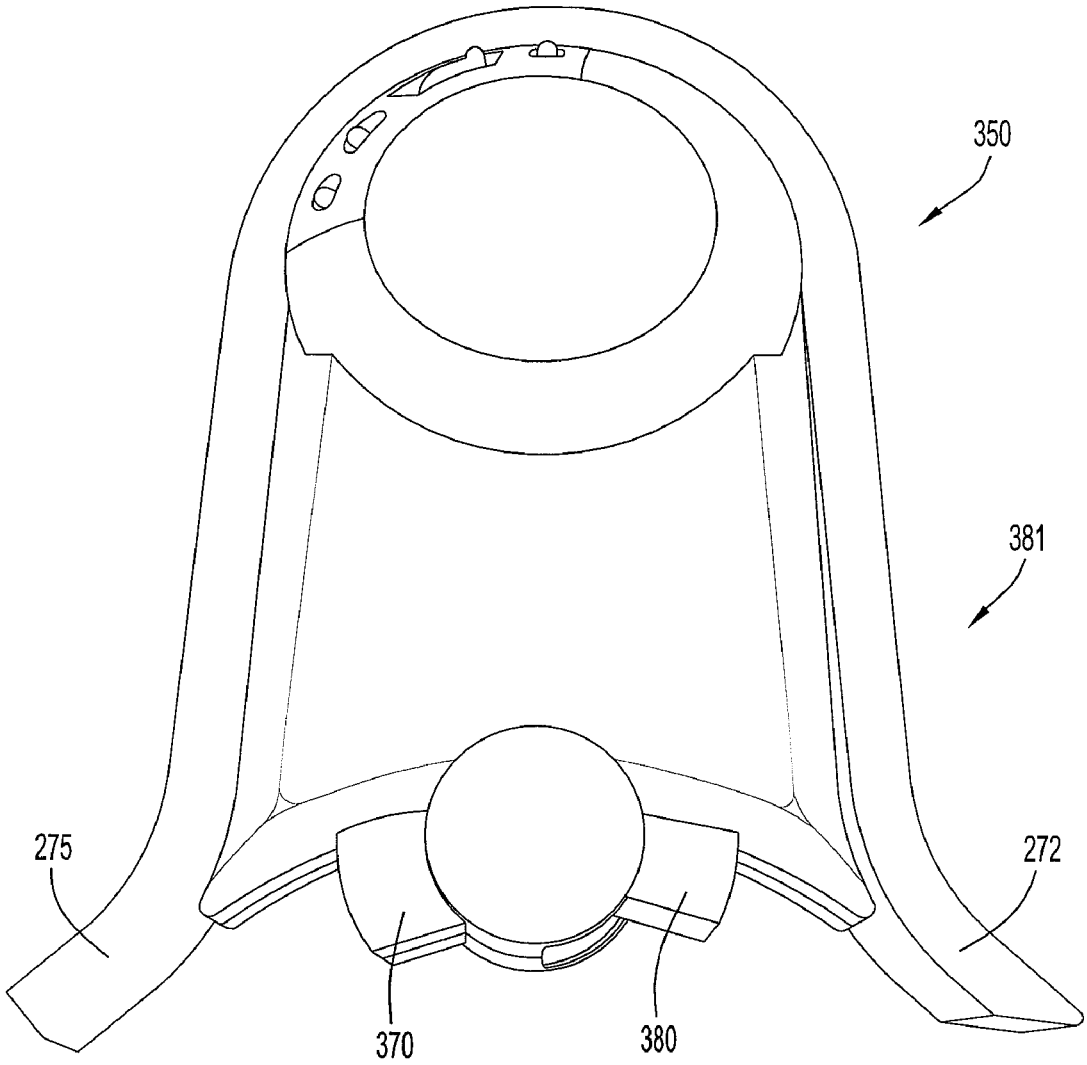
Figure 24:
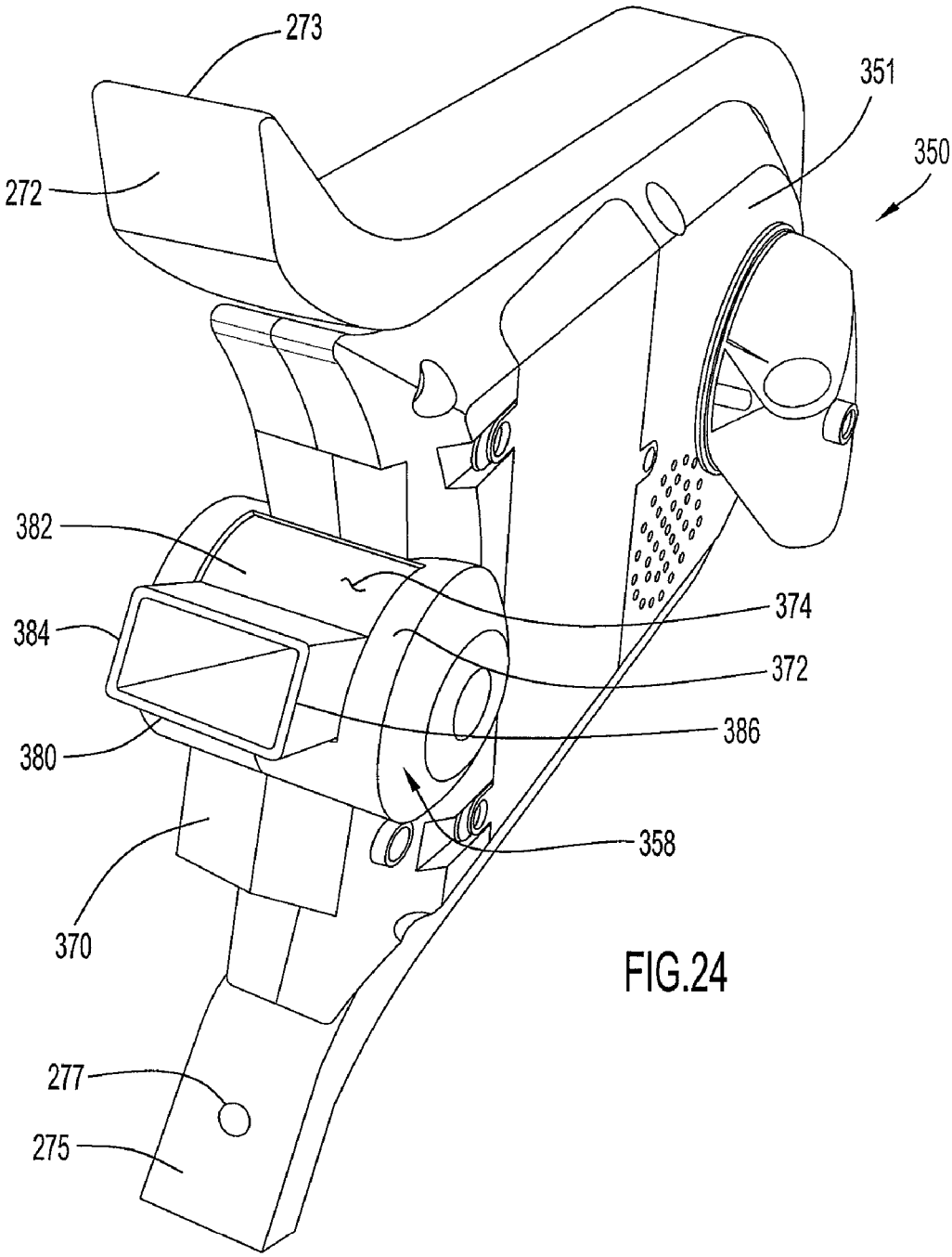
FIG. 24 is a bottom perspective view of the connector illustrated in FIG. 22.
Figure 25:
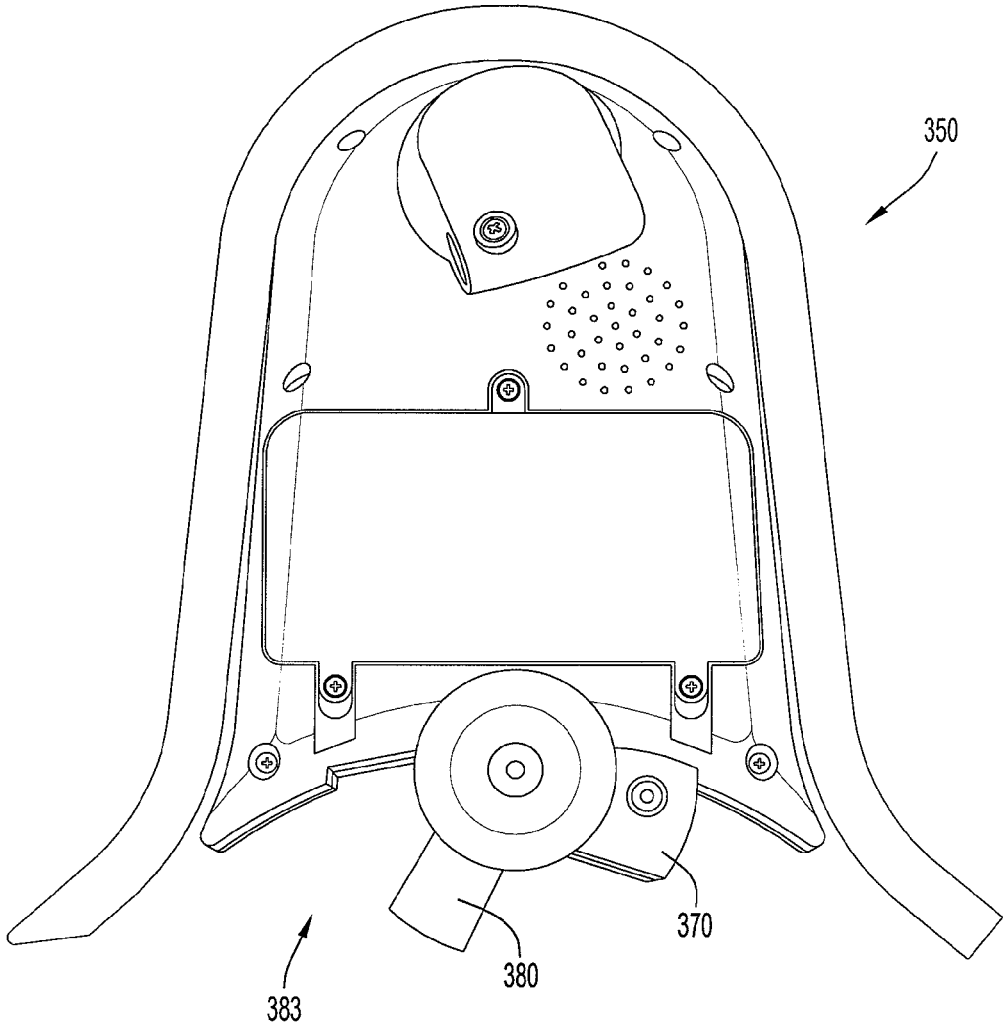
FIG. 25 is a side view of the connector illustrated in FIG. 22.

Referring to FIGS. 22-23 and 25, the connector 350 is illustrated with its moving coupler 380 in a collapsed position 383 (see FIGS. 22 and 25) and in a deployed position 381 (see FIG. 23). When only connector 350 is illustrated in FIGS. 22-25, it is to be understood that connector 300 may have similar features and components with the notable change that connector 300 in large part is a mirror-image of connector 350. In this embodiment, the connector 350 includes a molded plastic body 351 with a piece of wood 353 having opposite ends 272 and 275 coupled thereto. In different embodiments, the connector 350 may be a single component or piece of material. In other embodiments, the ends 272 and 275 of the connector 350 may be integrally formed with the body 351. As shown in FIGS. 22 and 23, coupler 370 is fixed to the body 351 and in this embodiment, coupler 370 is integrally formed with the body 351.

Referring to FIG. 24, a lower perspective view of the connector 350 is illustrated. As shown, engaging portion 272 includes end or tip 273 and end 275 includes an opening 277 for a fastener (not shown in FIG. 24). The lower end 358 of the body 351 includes an edge 372 that defines an opening 374 into an interior or cavity in the body 351. The coupler 380 includes a body portion 382 and a sleeve 384. The body portion 382 is positioned within the body 351, which can be formed by coupling to connector portions together using fasteners or other conventional techniques after the body portion 382 is in its position. A fastener, such as a screw, can be inserted through the lower end 358 and an opening in the body portion 382 to rotatably mount the coupler 380 to the body 351 of the connector 350.

The sleeve 384 extends outwardly through opening 374 and is configured to receive the upper end of a leg of a leg assembly therein. The leg can be coupled to the sleeve 384 by a fastener or other coupling mechanism. The range of motion of coupler 380 is determined by the length of the opening 374.

In various embodiments, the quantity of legs and leg assemblies that can be pivoted or rotated relative to each other can vary. In addition, the quantity of lock mechanisms and the locations of the lock mechanism can vary. The lock mechanisms can be placed at higher or lower positions along the legs than the positions in the illustrated embodiment of the infant support structure.

In an alternative embodiment, the upper ends of leg assembly 220 may be pivotally coupled to connectors 300 and 350. In addition, the upper ends of leg assembly 420 may be pivotally coupled to connectors 300 and 350. In this embodiment, lock mechanisms are coupled to each of the legs or portions of the leg assemblies 200 and 400 that are pivotally coupled the connectors 300 and 350. The lock mechanisms can be mounted and operated in the same manner as lock mechanisms 500 and 600 in that movement of both of the leg assemblies 200 and 400 can be prevented as desired.

In different embodiments, the frame of the infant support structure according to the present invention can vary. In one embodiment, the legs and/or lower portions of one or both leg assemblies can be substantially linear and not curved. In another embodiment, the frame can be used or function as a high chair. In yet another embodiment, the front leg assembly can include a single leg with a lower member and the rear leg assembly can include a single leg. Accordingly, a single lock mechanism can be provide on one of the leg assemblies to maintain the frame in its deployed configuration.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

What is claimed is:

1. An infant support structure, comprising:

a collapsible frame, the collapsible frame including:

a first frame portion, the first frame portion including a lower portion configured to engage a support surface;

a second frame portion, the second frame portion including a lower portion configured to engage the support surface, the second frame portion being pivotally coupled to the first frame portion, the second frame portion being positionable in a deployed position and in a collapsed position relative to the first frame portion; and a release mechanism, the release mechanism being coupled to the second frame portion at a location that is offset from a location at which the second frame portion is pivotally coupled to the first frame portion, the release mechanism being configured to receive part of the first frame portion to secure the second frame portion in its deployed position; and a support portion, the support portion being supported by the collapsible frame.

2. The infant support structure of claim 1, wherein the release mechanism includes a housing and a biasing mechanism, the housing being mounted to the second frame portion and movable between a locked position and an unlocked position, the biasing mechanism biasing the housing into its locked position.

3. The infant support structure of claim 1, wherein the first frame portion includes an upper end and a lower end, the second frame portion includes an upper end and a lower end, the upper end of the second frame portion is pivotally coupled to the upper end of the first frame portion.

4. The infant support structure of claim 1, wherein the second frame portion is a rear frame portion that includes a first leg, a second leg, and a lower member coupling the first leg and the second leg to each other.

5. The infant support structure of claim 4, wherein the release mechanism is coupled to the first leg of the rear frame portion.

6. The infant support structure of claim 1, wherein the second frame portion includes a first leg portion and a second leg portion, the release mechanism is a first release mechanism and is coupled to the first leg portion, the infant support structure further comprising:

a second release mechanism, the second release mechanism being coupled to the second leg portion, the second release mechanism being configured to receive part of the first frame portion to secure the second frame portion in its deployed position.

7. The infant support structure of claim 6, wherein the first release mechanism and the second release mechanism can be moved substantially simultaneously.

8. The infant support structure of claim 6, wherein the first frame portion includes a first engaging portion and a second engaging portion, the first release mechanism is configured to receive the first engaging portion, and the second release mechanism is configured to receive the second engaging portion.

9. An infant swing, comprising:

a front frame portion;

a rear frame portion, the rear frame portion being pivotally coupled to the front frame portion, the front frame portion and the rear frame portion being collectively positionable in a deployed configuration and in a collapsed configuration, the rear frame portion including a lock mechanism that is coupled to the rear frame portion at a location that is offset from a location at which the rear frame portion is pivotally coupled to the front frame portion, the lock mechanism being movable between an engaged position and a disengaged position, the lock mechanism in its engaged position receiving a portion of the front frame portion to secure the front frame portion and the rear frame portion in the deployed configuration, the lock mechanism in its disengaged position being configured to release the portion of the front frame portion to allow the front frame portion and the rear frame portion to move to the collapsed configuration; and a seat portion, the seat portion being movably supported by the front frame portion.

10. The infant swing of claim 9, wherein the lock mechanism includes a housing and a biasing mechanism, the housing being pivotally mounted to the rear frame portion, the biasing mechanism biasing the housing into the engaged position.

11. The infant swing of claim 9, wherein the front frame portion includes a pair of hubs and a front leg assembly with two upper ends, each of the hubs is coupled to one of the upper ends of the front leg assembly, the lock mechanism being configured to receive a portion of one of the hubs.

12. The infant swing of claim 9, wherein the rear frame portion includes a first leg portion and a second leg portion, each of the leg portions is pivotally coupled to the front frame portion, and the lock mechanism is coupled to the first leg portion of the rear frame portion.

13. The infant swing of claim 9, wherein the lock mechanism is a first lock mechanism, the infant swing further comprising:

a second lock mechanism, the second lock mechanism being coupled to the second leg portion, the second lock mechanism being configured to receive part of the front frame portion to secure the rear frame portion in its deployed position.

14. The infant swing of claim 13, wherein the first lock mechanism and the second lock mechanism can be moved independently of each other.

15. An infant support structure, comprising:

a first connector;

a second connector;

a first frame member, the first frame member being fixedly coupled to the first connector and to the second connector, the first frame member being configured to engage a support surface;

a second frame member, the second frame member being pivotally coupled to the first connector and to the second connector, the second frame member being configured to engage a support surface and being positionable in a deployed position and in a collapsed position relative to the first frame member, the second frame member including a lock mechanism coupled to the second frame member at a location that is offset from a location at which the second frame member is pivotally coupled to the first and second connectors, the lock mechanism being configured to receive a portion of the first connector to retain the second frame member in its deployed position; and a seat portion, the seat portion being supported by the first connector and the second connector.

16. The infant support structure of claim 15, wherein the first frame member includes a first leg member and a second leg member, the second frame member includes a first leg member and a second leg member, each of the first leg members is coupled to the first connector, and each of the second leg members is coupled to the second connector, and the lock mechanism is coupled to one of the leg members of the second frame member.

17. The infant support structure of claim 15, wherein the second frame member includes a first leg member and a second leg member, the lock mechanism is a first lock mechanism and is coupled to the first leg member, the infant support structure further comprising:

a second lock mechanism, the second lock mechanism being coupled to the second leg member of the second frame member, the second lock mechanism being configured to receive a portion of the second connector.

18. The infant support structure of claim 17, wherein the first lock mechanism and the second lock mechanism can be manipulated simultaneously.

19. The infant support structure of claim 15, wherein the lock mechanism is pivotally mounted to the second frame member.

20. The infant support structure of claim 15, wherein the first connector has a body portion and a housing rotatably coupled to the body portion, the second frame member includes an upper end, the upper end of the second frame member is coupled to the housing, the housing being rotatable relative to the body portion when the lock mechanism is disengaged from the first connector.

* * * * *